US006517981B1

(12) United States Patent
Olson et al.

(10) Patent No.: US 6,517,981 B1
(45) Date of Patent: Feb. 11, 2003

(54) COLOR PHOTOTHERMOGRAPHIC ELEMENT COMPRISING A DYE-FORMING SYSTEM FOR FORMING A NOVEL CYAN DYE

(75) Inventors: Leif P. Olson, Rochester, NY (US); Wojciech K. Slusarek, Rochester, NY (US); James H. Reynolds, Rochester, NY (US); Richard P. Szajewski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/930,939

(22) Filed: Aug. 16, 2001

(51) Int. Cl.[7] ..... G03C 8/40; G03C 7/384

(52) U.S. Cl. ..... 430/21; 430/350; 430/505; 430/554; 430/558; 430/566; 430/959

(58) Field of Search ..... 430/350, 566, 430/21, 619, 505, 959, 554, 558

(56) References Cited

U.S. PATENT DOCUMENTS 4,789,623 A * 12/1988 Sato et al. ..... 430/351
5,248,739 A 9/1993 Schmidt et al.
5,415,981 A 5/1995 Clarke et al.
5,756,269 A 5/1998 Ishikawa et al.
6,197,722 B1 3/2001 Irving et al.

FOREIGN PATENT DOCUMENTS

EP 0800114 * 10/1997 ..... G03C/8/40
JP 10090854 A 9/1996

OTHER PUBLICATIONS

Photographic Science & Engineering, vol. 8, No. 3, May–Jun. 1964, Title: Correlation of Some Physical and Chemical Properties of Substituted p–Phenylenediamines and Their Dye Derivatives, pp. 125–137, R.L. Bent et al.

* cited by examiner

*Primary Examiner*—Thorl Chea
(74) *Attorney, Agent, or Firm*—Chris P. Konkol

(57) ABSTRACT

A light-sensitive silver-halide color photothermographic element comprises a typically magenta dye-forming pyrazolone coupler in the cyan record by rendering the hue of the resultant dye a cyan hue. The use of certain para-phenylenediamine developers, for example, containing a substituent group in both the 2- and 6-positions (ortho, ortho') relative to the coupling nitrogen, along with selected magenta dye-forming couplers, when oxidized, yield cyan dyes with certain couplers, resulting in the superior non-hue characteristics of magenta couplers in the cyan layer. By means of the present invention, light sensitive color photothermographic elements can form image dye records of consistent density forming ability and consistent stability in all three color records. Also disclosed is a method of processing such a color photographic element.

24 Claims, No Drawings

COLOR PHOTOTHERMOGRAPHIC ELEMENT COMPRISING A DYE-FORMING SYSTEM FOR FORMING A NOVEL CYAN DYE

FIELD OF THE INVENTION

The present invention is directed to a color photothermographic element comprising a hue-shifting phenylenediamine developing agent, or precursor thereof, in reaction association with a pyrazolone coupler for forming a cyan imaging dye.

BACKGROUND OF THE INVENTION

U.S. Pat. No. 5,756,269 to Ishikawa et al. discloses the combination of three different developers with three different couplers. For example, a coupler "Y-1" is used with a hydrazide developing agent to form a yellow dye. Ishikawa et al. does not mention, nor attach any significance to, the fact that the same coupler is a magenta dye-forming coupler if used with a common phenylenediamine developing agent.

Clarke et al., in U.S. Pat. Nos. 5,415,981 and 5,248,739, showed that azo dyes formed from a blocked hydrazide developer are shifted to shorter wavelengths. This is perhaps not surprising since azo dyes derived from "magenta couplers" are known to be typically yellow and are used as masking couplers. The substitution pattern on the masking coupler is such that it can undergo further reaction with the oxidixed form of a paraphenylene diamine developer to form a magenta dye.

R. L. Bent et al., in *Photographic Science and Engineering*, Vol. 8, No. 3, May-June 1964 disclosed that the frequencies of maximum absorption of various dyes derived from p-phenylenediamines are closely related to the half-wave oxidation potentials of the compounds. As one point on various plotted correlations, experimental Compound A is disclosed (in Table II), in a 4-amino-N,N-dialkylaniline structure has 3,5-di-$CH_3$ substitution. The compounds are not disclosed as having any commercial utility and the reference might be construed as teaching that the use of Compound A would not be useful, since it would not provide the desired magenta hue with a conventional magenta coupler.

Japanese kokai JP 10090854 (1996) teaches different developers in the same color unit layer (having spectral sensitivity in the same wavelength range) in a photothermographic imaging element, in order to obtain better image or tone gradation.

U.S. Pat. No. 6,197,722 B1 to Irving et al. teaches a method of imaging, useful comprising providing an imaging member having at least one light insensitive layer comprising a catalytic center and multifunctional dye forming coupler, imagewise applying distinct developer solutions that will react with the multifunctional dye forming coupler to produce dyes of different colors. A preferred method of imagewise application of developer solution is by the technique known as "ink jet."

PROBLEM TO BE SOLVED BY THE PRESENT INVENTION

Light-sensitive imaging elements which form yellow, magenta and cyan dye records of comparable density-forming ability and consistent stability in all three color records using conventional developers can be difficult. Cyan and yellow dye records can be a problem in this regard, especially in photothermographic elements. Accordingly, alternative ways of forming cyan or yellow dyes are especially useful in such imaging elements.

Another problem with conventional cyan dye-forming couplers relates to the fact that the raw stock stability of photographic elements is influenced by the physical properties of materials employed to formulate that element. Cyan dye-forming couplers are particularly prone to crystallization on extended cold keeping. This crystallization both degrades the image-forming ability of such an element and mars the appearance of images produced in such an element. This problem can be particularly acute in photothermographic or heat developable elements since it may be desirable to keep these elements cold before use, in order to prevent premature reaction.

SUMMARY OF THE INVENTION

It has been found advantageous to use a pyrazalone type of dye-forming coupler in the cyan record of a photothermographic element, in association with a para-phenylene diamine developer containing a substituent in both the 2- and 6-positions (ortho, ortho') relative to the coupling nitrogen. Such developers when oxidized yield cyan dyes with these couplers. With more conventional developers, these same couplers yield a magenta hue rather than a cyan hue. Moreover, pyrazolone couplers have been found to exhibit excellent reactivity in color photothernographic systems. Thus, according to the present invention, the superior characteristics of the pyrazolone couplers and the dyes formed therefrom can be utilized in the cyan layer.

Further, this invention describes the use of these pyrazolone 10 couplers in combination with the appropriate developers, blocked or unblocked, in a thermally-processable system or other incorporated-developer photographic element. In one embodiment, improved properties have been obtained when, according to the present invention, the dye-forming coupler and blocked developer according to the present invention, a cyan dye is formed in a thermally-processed film. In particular, a surprising and significant increase in maximum density (Dmax) is obtained with only minor increases in Dmin, compared to the use of a commonly employed cyan dye-forming coupler with a conventional blocked conventional developer.

DETAILED DESCRIPTION OF THE INVENTION

As mentioned above, the invention relates to a light-sensitive color photographic imaging element comprising, in reactive association, a pyrazolone coupler and a "developer precursor" that liberates a developing agent enabling cyan color from the coupler on development. In particular, a "typically magenta pyrazolone dye-forming coupler" is used in the cyan dye-forming record by rendering the hue of the resultant dye a cyan hue. In one embodiment, this is accomplished by using a para-phenylene diamine developer containing substituents, preferably a methyl group, in both the 2- and 6-positions (ortho, ortho') relative to the coupling nitrogen along with selected magenta dye-forming couplers. By the term "typically magenta dye-forming coupler" is meant that the coupler forms a magenta dye with an oxidized form of the conventional developer 4-(N-ethyl-N-2-hydroxyethyl)-2-methylphenylenediamine.

In one embodiment, the coupler-developer combination according to the present invention, in which the developer is blocked or otherwise a developer precursor, is used in a thermally-processable system or other incorporated-developer photographic element where the incorporated developer chosen for each color-forming record need not be identical in structure, but are chosen to utilize the optimal developer-coupler combination. Thus, the invention encompasses the possible use of a one or more different couplers (preferably at least two) and one or more different developing agents (preferably at least two). There can be one, two, or three different couplers in the same imaging element. It is possible to have more than three couplers, for example, per the Japanese kokai mentioned above. It is also possible to have more than three different developers (or blocked developers), three different developers (or blocked developers), two different developers (or blocked developers), or a single developer (or blocked developer).

In a preferred variant, the element is a photothermographic element that is dry developed by heat treatment. In another variant, an imagewise exposed photothermographic element is developed by treatment with both heat and chemical base or acid, either by contacting the element to a pH controlling solution or by contacting the element to a pH controlling laminate.

When the formed image is intended for human viewing, a first blocked coupling developer is cyan dye forming, a second blocked coupling developer is magenta dye forming, and a third blocked coupling developer is yellow dye forming. Preferably, the pyrazolone coupler is present, in reactive association, with a blocked developer, in the red-light-sensitive color layer unit. However, if the formed image is to be scanned, it is possible to produce other colored dyes.

Preferably, the imaging element comprises a blocked form of a developer that results in a cyan dye being formed when the oxidized form of the developer is reacted with the coupler of the present invention. Preferably, the developer is the neutral or photographically acceptable salt form of the compound represented by the following Structure I:

I

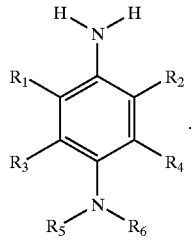

$R^1$, $R^2$, $R^3$, $R^4$, $R^5$ and $R^6$ which can be the same or different are individually H, alkyl, substituted alkyl, alkenyl, substituted alkenyl, aryl, substituted aryl, halogen, cyano, hydroxy, alkoxy, substituted alkoxy, aryloxy, substituted aryloxy, amino, substituted amino, alkylcarbonamido, substituted alkylcarbonamido, arylcarbonamido, substituted arylcarbonamido, alkylsulfonamido, arylsulfonamido, substituted alkylsulfonamido, substituted arylsulfonamido, or sulfamyl or wherein at least two of $R^1$, $R^2$, $R^3$ and $R^4$, $R^5$ and $R^6$ together further form a substituted or unsubstituted carbocyclic or heterocyclic ring structure; except that neither $R^1$ nor $R^2$ can be H. In one embodiment, the $R^3$ and $R^5$ and the $R^4$ and $R^6$ groups form a tetrahydroquinoline (THQ) structure.

Preferably, $R^1$ and $R^2$ is a substituted or unsubstituted alkyl or alkoxy or an alkylsulfonamido, more preferably a C1 to C4 alkyl or alkoxy, most preferably, the alkyl is an n-alkyl substituent. Preferably, $R^3$ and $R^4$ are hydrogen. Preferably, $R^5$ and $R^6$ are independently hydrogen or a substituted or unsubstituted alkyl group or $R^5$ and $R^6$ are connected to form a ring;

More preferably, the unblocked developer (after being released from the blocked developer during development) is the neutral or photographically acceptable salt form of the compound represented by the following Structure II:

II

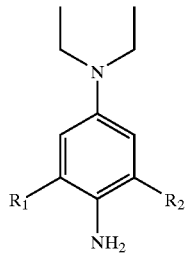

Wherein $R^1$ and $R^2$ are as described above.

A specific example of an unblocked developing agent useful in the present invention, in neutral or salt form, is represented by the following Structure III:

III

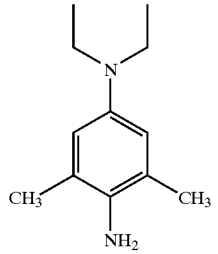

Preferably, at least one other color unit layer, more preferably two other color unit layers, contains a second developer which is also a phenylene diamine developer that, however, differs from that of structure III. Some specific examples of such other developers include, but are not limited, to N,N-diethyl-p-phenylenediamine, 4-N,N-diethyl-2-methylphenylenediamine, 4-(N-ethyl-N-2-methanesulfonylaminoethyl)-2-methylphenylenediamnine, 4-(N-ethyl-N-2-hydroxyethyl)-2-methylphenylenediamine, 4-N,N-diethyl-2-methanesulfonylaminoethylphenylenediamine, 4-(N-ethyl-N-2-methoxyethyl)-2-methyiphenylenediamine, 4,5-dicyano-2-isopropylsulfonylhydrazinobenzene and 4-amino-2,6-dichlorophenol. *The Theory of the Photographic Process*, 4th ed., T. H. James, ed., Macmillan, New York 1977 at pages 291 through 403, the disclosures of which are incorporated by reference, discloses some specific developers useful in the practice of this invention. Other useful developers and developer precursors are disclosed by Hunig et al, *Angew. Chem.*, 70, page 215-ff (1958), by Schmidt et al, U.S. Pat. No. 2,424,256, Pelz et al, U.S. Pat. No. 2,895,825, Wahl et al, U.S. Pat. No. 2,892,714, Clarke et al, U.S. Pat. Nos. 5,284,739 and 5,415,981, Takeuchi et al, U.S. Pat. No. 5,667,945, and Nabeta U.S. Pat. No. 5.723,277 the disclosures of which are incorporated by reference.

Suitably, the specified cyan dye-forming coupler is any pyrazolone coupler, preferably a 3-anilino-5-pyrazalone-type coupler, including known couplers and derivatives thereof, that possesses the property of forming a cyan dye with the oxidized forms of the color developers of the present invention. The leaving group X is preferably halogen (chloro, fluoro or bromo), triazoles, hydantoin, thiophenol, substituted or unsubstituted. More preferably, the leaving group X is a halogen or a thiophenol, the later substituted or unsubstituted.

As used herein and throughout the specification unless where specifically stated otherwise, the term "alkyl" refers to an unsaturated or saturated, straight or branched chain alkyl group, including alkenyl and aralkyl, and includes cyclic alkyl groups, including cycloalkenyl, and the term "aryl" includes specifically fused aryl.

When reference in this application is made to a particular moiety, or group, this means that the moiety may itself be unsubstituted or substituted with one or more substituents (up to the maximum possible number). For example, "alkyl" or "alkyl group" refers to a substituted or unsubstituted alkyl, while "aryl group" refers to a substituted or unsubstituted benzene (with up to five substituents) or higher aromatic systems. Generally, unless otherwise specifically stated, substituent groups usable on molecules herein include any groups, whether substituted or unsubstituted, which do not destroy properties necessary for the photographic utility of the compound, whether coupler utility or otherwise. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched, unbranched or cyclic.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups. Generally, unless indicate otherwise, alkyl, aryl, and other carbon-containing groups and substituents thereof may include those having up to 48 carbon atoms, typically 1 to 36 carbon atoms and usually less than 24 carbon atoms, but greater numbers are possible depending on the particular substituents selected. For example, ballast groups for couplers will tend to have more carbon atoms than other groups on the coupler.

In one embodiment of the present invention, the coupler has the structure IV

IV

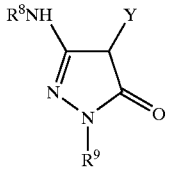

This structure represents couplers called 5-pyrazolone couplers. In the structure, $R^8$ represents an alkyl group, an aryl group, an acyl group or a carbamoyl group, $R^9$ represents a phenyl group or a phenyl group having at least one halogen atom, or at least one alkyl, cyano, alkoxyl, alkoxycarbonyl or acylamino group as a substituent group. Of the pyrazolone couplers represented by Structure IV, couplers are preferred in which $R^8$ is an aryl group or an acyl group and $R^9$ is a phenyl group having at least one halogen atom as a substituent group. Preferably, $R^8$ is an aryl group such as phenyl, 2-chlorophenyl, 2-methoxyphenyl, 2-chloro-5-tetradecaneamidophenyl, 2-chloro-(3-octadecenyl-1-succinimido)phenyl, 2-chloro-5-octadecylsulfonamidophenyl or 2-chloro-5-[2-(4-hydroxy-3-t-butylphenoxy)-tetradecaneamido]phenyl, or an acyl group such as acetyl, pivaloyl, tetradecanoyl, 2-(2,4-di-t-pentylphenoxy)acetyl, 2-(2,4-di-t-pentylphenoxy)butanoyl, benzoyl or 3-(2,4-di-t-amylphenoxyacetamido)benzoyl. $R^9$ is preferably a substituted phenyl group such as 2,4,6-trichlorophenyl, 2,5-dichlorophenyl or 2-chlorophenyl. In structure (IV) above, Y is a hydrogen atom or a group (elimination or coupling-off group) which is removable by the coupling reaction with a developing agent oxidant. Polymeric forms of the pyrazolone couplers may be used, as will be understood by the skilled artisan.

Examples of the groups represented by Y functioning as anionic removable groups of the 2-equivalent-coupler type include halogen atoms (for example, chlorine and bromine), an aryloxy group (for example, phenoxy, 4-cyanophenoxy or 4-alkoxycarbonylphenyl), an alkylthio group (for example, methylthio, ethylthio or butylthio), an arylthio group (for example, phenylthio or tolylthio), an alkylcarbamoyl group (for example, methyl-carbamoyl, dimethylcarbamoyl, ethylcarbamoyl, diethyl-carbamoyl, dibutylcarbamoyl, piperidylcarbamoyl or morpholyl-carbamoyl), an arylcarbamoyl group (for example, phenyl-carbamoyl, methylphenylcarbamoyl, ethylphenylcarbamoyl or benzylphenylcarbamoyl), a carbamoyl group, an alkylsulfamoyl group (for example, methylsulfamoyl, dimethylsulfamoyl, ethylsulfamoyl, diethylsulfamoyl, dibutylsulfamoyl, piperidylsulfamoyl or morpholylsulfamoyl), an arylsulfamoyl group (for example, phenylsulfamoyl, methylphenylsulfamoyl, ethylphenylsulfamoyl or benzylphenylsulfamoyl), a sulfamoyl group, a cyano group, an alkylsulfonyl group (for example, methanesulfonyl or ethanesulfonyl), an arylsulfonyl group (for example, phenylsulfonyl, 4-chlorophenylsulfonyl or p-toluenesulfonyl), an alkylcarbonyloxy group (for example, acetyloxy, propionyloxy or butyroyloxy), an arylcarbonyloxy group (for example, benzoyloxy, tolyloxy or anisyloxy) and a nitrogen-containing heterocyclic group (for example, imidazolyl or benzotriazolyl).

Further, the groups functioning as the cationic removable groups of a 4-equivalent coupler include a hydrogen atom, a formyl group, a carbamoyl group, a methylene group having a substituent group (an aryl group, a sulfamoyl group, a carbamoyl group, an alkoxyl group, an amino group, a hydroxyl group or the like as the substituent group), an acyl group and a sulfonyl group.

In Structure (IV), the above-mentioned groups may further have substituent groups, each of which is an organic substituent group linked through a carbon atom, a oxygen atom, a nitrogen atom or a sulfur atom, or a halogen atom.

Preferred pyrazolone couplers are of the Structure (V):

(V)

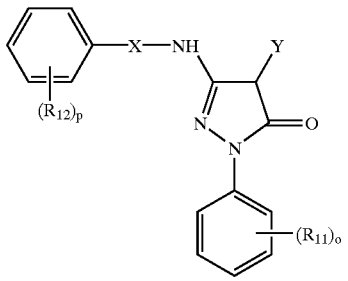

wherein $R_{11}$ is a substituent from the group comprising halogen, CN, alkylsulphonyl, arylsulphonyl, sulphamoyl, sulphamido, carbamoyl, carbonamido, alkoxy, acyloxyl, aryloxy, alkoxycarbonyl, ureido, nitro, alkyl and trifluoromethyl, $R_{12}$ is a substituent such as $R^{11}$ or aryl, alkylsulphoxyl, arylsulphoxyl, acyl, imido, carbamato, heteroacylyl, alkylthio, carboxyl or hydroxyl, Y means an elimination or coupling-off group, X means a direct bond or CO and o and p mean 0 or a number from 1 to 5, wherein, should o and/or p be>1, the substituents $R_{11}$ or $R_{12}$ may be identical or different.

Preferred elimination groups are halogen, alkoxy, aryloxy, alkylthio, arylthio, acyloxy, sulphonamido, sulphonyloxy, carbonamido, arylazo, imido, nitrogenous heterocyclic residues and hetarylthio residues.

Particularly prefelTed magenta couplers are of the Structure (VI)

(VI)

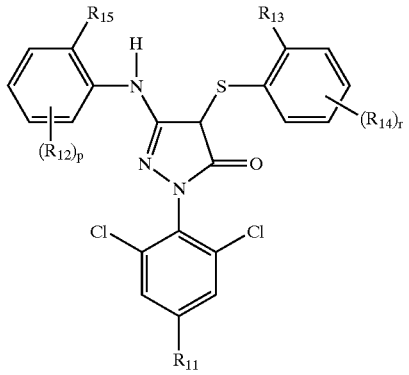

wherein $R_{11}$ and $R_{12}$ is defined above, $R_{13}$ is acylamino or sulphonylamino; $R_{14}$ is hydrogen or an organic residue, preferably hydrogen, $R_{15}$ is chlorine or C1–C4 alkoxy, and r and p mutually independently mean 0, 1 or 2. Such couplers are described in U.S. Pat. No. 5,702,877, hereby incorporated by reference.

In one preferred embodiment, the coupler will be a member of a class of couplers represented by the following Structure (VII):

VII

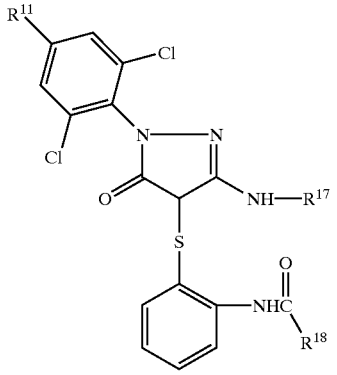

wherein $R^{11}$ is as defined above, $R^{17}$ is a chloro-alkanamido substituted phenyl, and $R^{18}$ is a substituted or unsubstituted phenoxy alkyl.

Pyrazolone couplers useful in the practice of this invention are described in *Research Disclosure*, Item 38957, Section X. Dye Image Formners and Modifiers, in *Research Disclosure*, Item 37038 (1995), in Katz and Fogel, *Photographic Analysis*, Morgan & Morgan, Hastings-on-Hudson, New York, 1971 in the Appendix, in Lau et al, U.S. Pat. No. 5,670,302, and in European Patent Application EP 0,762,201 A1 the disclosures of which are all incorporated by reference.

Some specific examples of pyrazolone cyan-dye-forming couplers are the following:

C-1

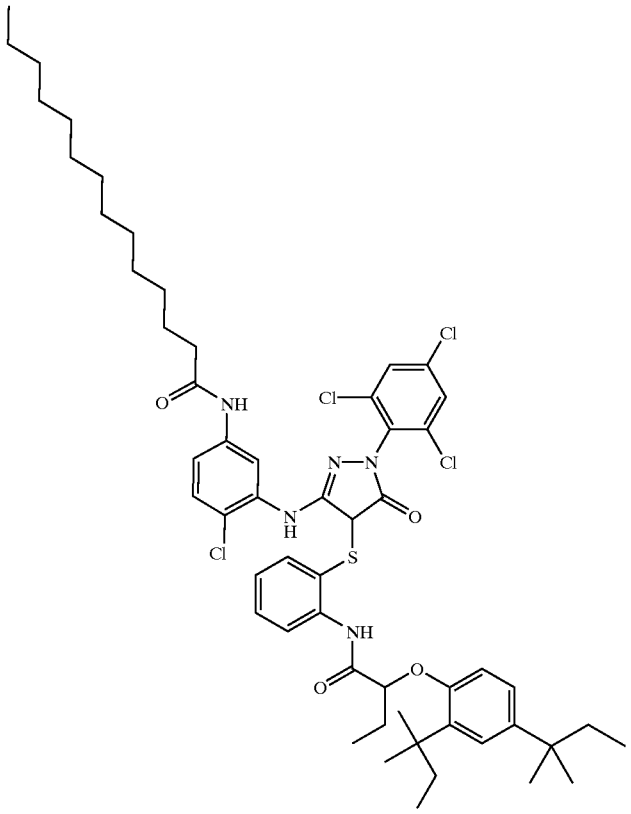

-continued
C-2
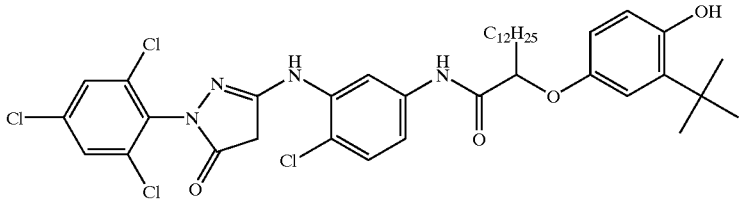
C-3
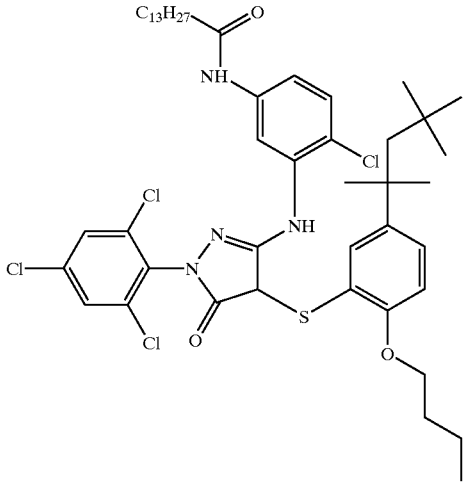
C-4
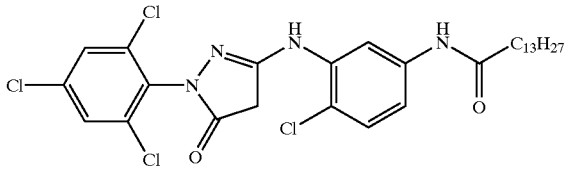
C-5
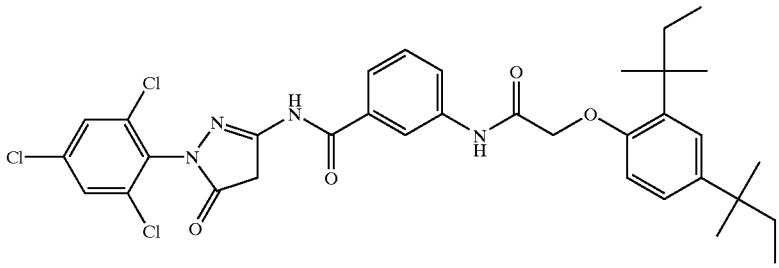
C-6
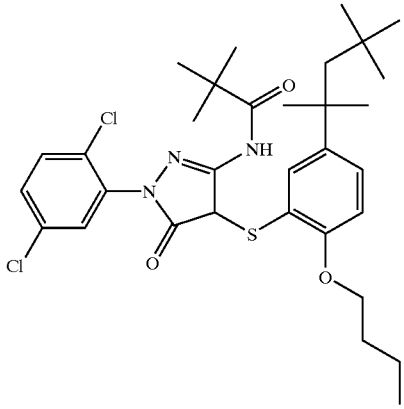

-continued
C-7
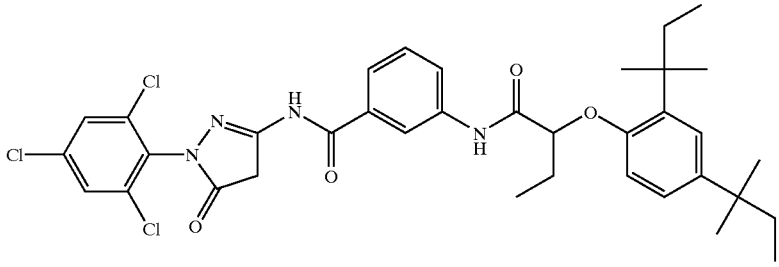
C-8
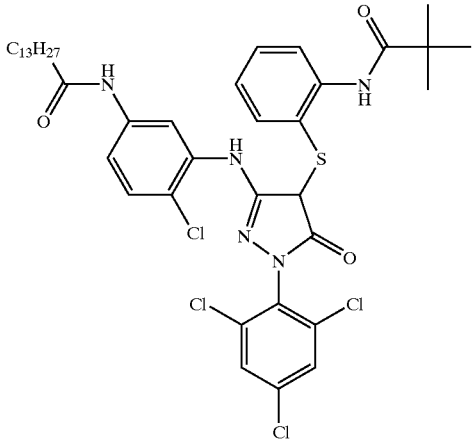
C-9
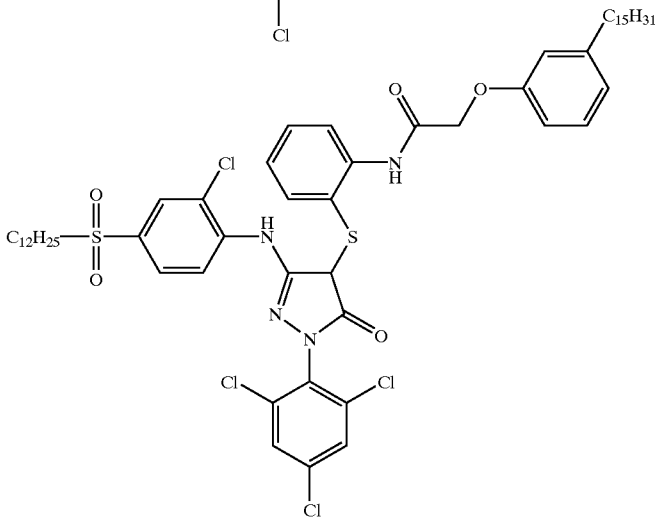
C-10
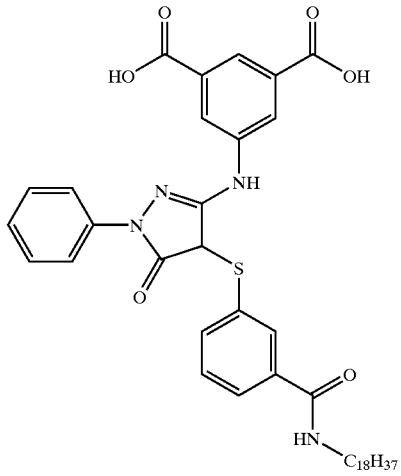

-continued
C-11
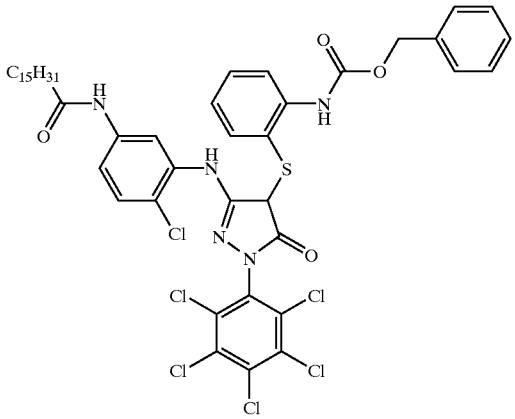
C-12
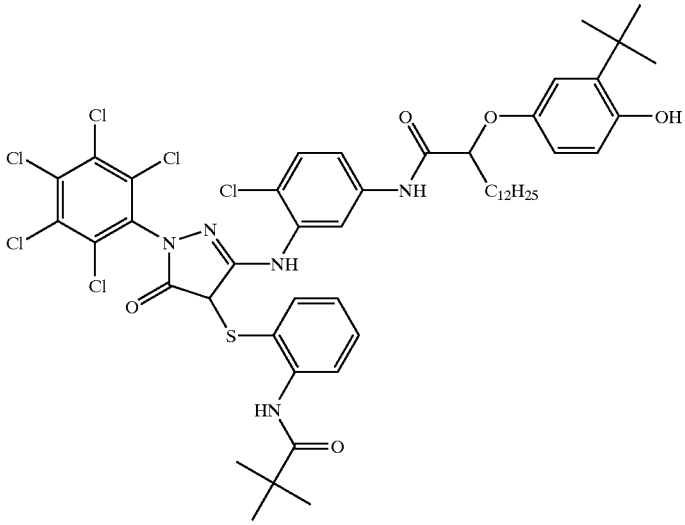
C-13
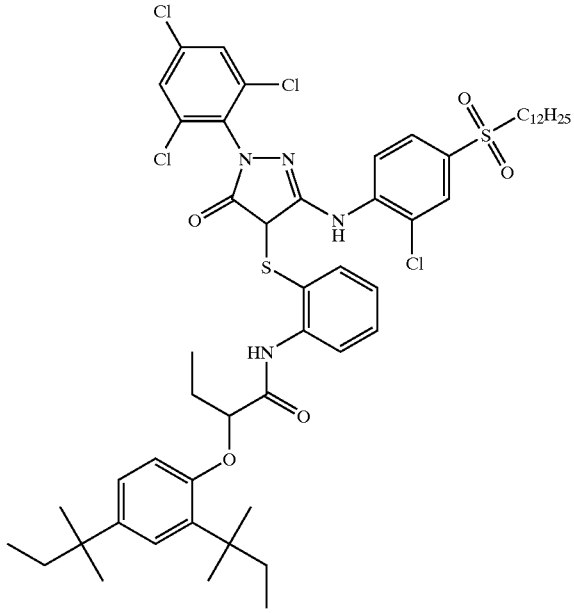

-continued

C-14

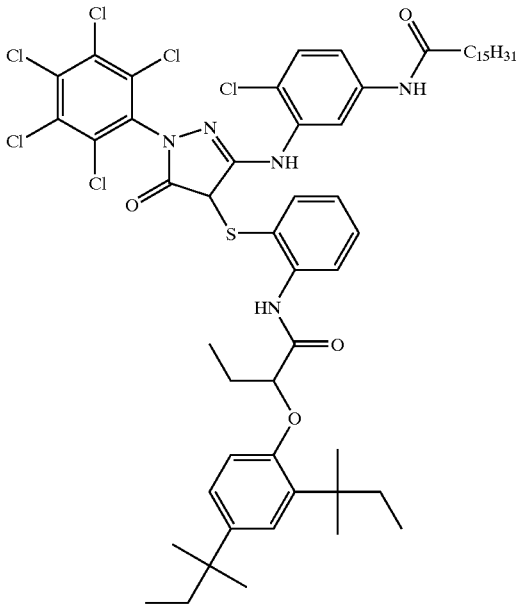

C-15

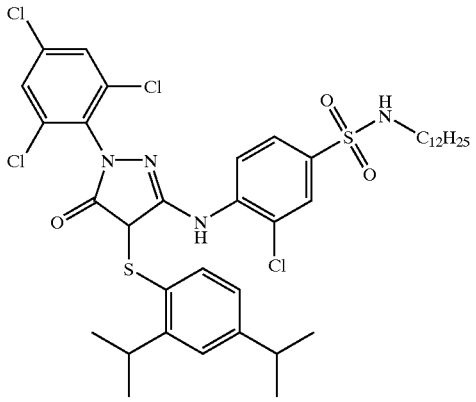

C-16

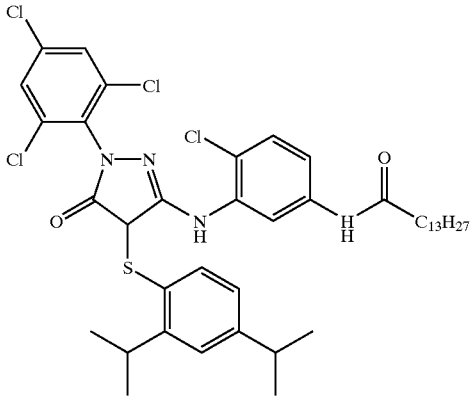

C-17

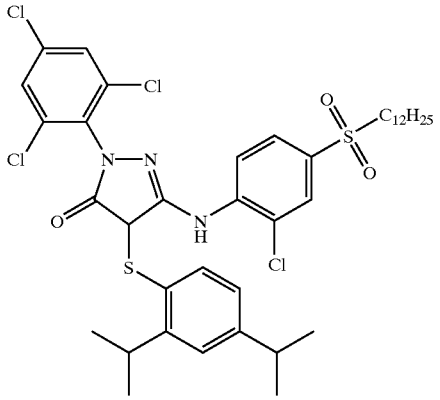

The specified cyan dye-forming couplers useful in the invention can be incorporated in the imaging member in any manner known in the art. These methods include, but are not limited to, incorporation as oil-in-water emulsions, known colloquially in the photographic arts as "dispersions," as reverse phase emulsion, as solid particle dispersions, as multiphase dispersions, as molecular dispersions or "Fisher" dispersions, or as polymer loaded dispersions or loaded latex dispersions. When the cyan dye-forming couplers are polymeric in nature, they can additionally be incorporated merely by physically diluting the polymeric coupler with vehicle. While the cyan dye-forming coupler can be employed in the member at any concentration that enables the desired formation of a multicolor image, it is preferred that the cyan dye-forming coupler be applied to the member at between about 50 and 3000 mg/m. It is more preferred that the cyan dye-forming coupler be applied to the member at between about 200 and 800 mg/m$^2$.

The imaging member can further comprise an incorporated solvent. In one embodiment the cyan dye-forming coupler is provided as an emulsion in such a solvent. In this embodiment, any of the high boiling organic solvents known in the photographic arts as "coupler solvents" can be employed. In this situation, the solvent acts as a manufacturing aid. Alternatively, the solvent can be incorporated separately. In both situations, the solvent can further function as a coupler stabilizer, a dye stabilizer, a reactivity enhancer or moderator or as a hue shifting agent, all as known in the photographic arts. Additionally, auxiliary solvents can be employed to aid dissolution of the cyan dye-forming coupler in the coupler solvent. Particulars of coupler solvents and their use are described in the aforesaid mentioned references and at *Research Disclosure*, Item 37038 (1995), Section IX, Solvents, and Section XI, Surfactants, incorporated herein by reference. Some specific examples of coupler solvents include, but are not limited to, tritoluyl phosphate, dibutyl phthalate, N,N-diethyldodecanamide, N,N-dibutyldodecanamide, tris(2-ethylhexyl)phosphate, acetyl tributyl citrate, 2,4-di-tert-pentylphenol, 2-(2-butoxyethoxy)ethyl acetate and 1,4-cyclohexyldimethylene bis(2-ethylhexanoate). The choice of coupler solvent and vehicle can influence the hue of dyes formed as disclosed by Merkel et al at U.S. Pat. Nos. 4,808,502 and 4,973,535. Typically, it is found that materials with a hydrogen bond donating ability can shift dyes bathochromically while materials with a hydrogen bond accepting ability can shift dyes hypsochromically. Additionally, use of materials with low polarizability can of itself promote hypsochromic dye hue shifts as well as promote dye aggregation. It is recognized that coupler ballasts often enable dyes and dye-coupler mixtures to function as self-solvents with a concomitant shift in hue. The polarizability, and the hydrogen bond donating and accepting ability of various materials are described by Kamlet et al in *J. Org. Chem*, 48, 2877–87 (1983), the disclosures of which are incorporated by reference.

Generally one or more developer precursors are employed in the practice of this invention and are incorporated in the imaging element during manufacture, one of which is the blocked developer according to the present invention. Preferably, at least two types of developers are used. The developer precursors can release any developers known in the art that are coupling developers and enable the formation of distinctly colored dyes from the same coupler. By distinctly colored is meant that the dyes formed differ in the wavelength of maximum adsorption by at least 50 nm. It is preferred that these dyes differ in the maximum adsorption wavelength by at least 65 nm and more preferred that they differ in the maximum adsorption wavelength by at least 80 nm. It is further preferred that, in addition to the cyan dye, a magenta and a yellow dye are formed. Preferably a cyan dye-forming developer, a magenta dye-forming developer and a yellow dye-forming developer are employed to form respectively cyan, magenta and yellow dyes from the same coupler. In another embodiment, a black dye forming developer is additionally employed. In yet another embodiment multiple cyan dye forming, magenta dye forming and yellow dye forming developers can be individually employed to form a greater gamut of colors or to form colors at greater bit depth.

A cyan dye is a dye having a maximum absorption at between 580 and 700 nm, with preferably a maximum absorption between 590 and 680 nm, more preferably a peak absorption between 600 and 670 nm and most preferably a peak absorption between 605 and 655 nm. A magenta dye is a dye having a maximum absorption at between 500 and 580 nm, with preferably a maximum absorption between 515 and 565 nm, more preferably a peak absorption between 520 and 560 nm and most preferably a peak absorption between 525 and 555 nm. A yellow dye is a dye having a maximum absorption at between 400 and 500 nm, with preferably a maximum absorption between 410 and 480 nm, more preferably a peak absorption between 435 and 465 nm and most preferably a peak absorption between 445 and 455 nm.

The concentrations and amounts of the developers and the dye-forming couplers according to the present invention will typically be chosen so as to enable the formation of dyes having a density at maximum absorption of at least 0.7, preferably a density of at least 1.0, more preferably a density of at least 1.3 and most preferably a density of at least 1.6. Further, the dyes will typically have a half height band width (HHBW) of between 70 and 170 nm in the region between 400 and 700 nm. Preferably, the HHBW will be less than 150 nm, more preferably less than 130 nm and most preferably less than 115 nm. Additional details of preferred dye hues are described by McInerney et al in U.S. Pat. Nos. 5,679,139, 5,679,140, 5,679,141 and 5,679,142, the disclosures of which are incorporated by reference.

A typical color negative film construction useful in the practice of the invention is illustrated by the following element, SCN-1:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

Details of support construction are well understood in the art. Examples of useful supports are poly(vinylacetal) film, polystyrene film, poly(ethyleneterephthalate) film, poly (ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure*, September 1996, Number 389, Item 38957 (hereafter referred to as ("*Research Disclosure I*").

The photothermographic elements of the invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. In this case, the coupler containing layer is usually the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m. In another embodiment, sensitized layers disposed on two sides of a support, as in a duplitized film, can be employed.

In a preferred embodiment of this invention, the processed photographic film contains only limited amounts of color masking couplers, incorporated permanent Dmin adjusting dyes and incorporated permanent antihalation dyes. Generally, such films contain color masking couplers in total amounts up to about 0.6 mmol/m$^2$, preferably in amounts up to about 0.2 mmol/m$^2$, more preferably in amounts up to about 0.05 mmol/m$^2$, and most preferably in amounts up to about 0.01 mmol/m$^2$.

The incorporated permanent Dmin adjusting dyes are generally present in total amounts up to about 0.2 mmol/m$^2$, preferably in amounts up to about 0.1 mmol/m$^2$, more preferably in amounts up to about 0.02 mmol/m$^2$, and most preferably in amounts up to about 0.005 mmol/m$^2$.

The incorporated permanent antihalation density is up to about 0.6 in blue, green or red density, more preferably up to about 0.3 in blue, green or red density, even more preferably up to about 0.1 in blue, green or red density and most preferably up to about 0.05 in blue, green or red Status M density.

Limiting the amount of color masking couplers, permanent antihalation density and incorporated permanent Dmin adjusting dyes serves to reduce the optical density of the films, after processing, in the 350 to 750 nm range, and thus improves the subsequent scanning and digitization of the imagewise exposed and processed films.

Overall, the limited Dmin and tone scale density enabled by controlling the quantity of incorporated color masking couplers, incorporated permanent Dmin adjusting dyes and antihalation and support optical density can serve to both limit scanning noise (which increases at high optical densities), and to improve the overall signal-to-noise characteristics of the film to be scanned. Relying on the digital correction step to provide color correction obviates the need for color masking couplers in the films.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. However, in a preferred embodiment, a preponderance low reflectivity grains are preferred. By preponderance is meant that greater than 50% of the grain projected area is provided by low reflectivity silver halide grains. It is even more preferred that greater than 70% of the grain projected area be provided by low reflectivity silver halide grains. Low reflective silver halide grains are those having an average grain having a grain thickness >0.06, preferably >0.08, and more preferable >0.10 microns. The grains preferably form surface latent images so that they produce negative images when processed in a surface developer in color negative film forms of the invention.

Illustrations of conventional radiation-sensitive silver halide emulsions are provided by *Research Disclosure I*, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. A red light sensitive layer unit comprises an emulsion having primary sensitivity to light in the 600 to 700 nm range. A green light sensitive layer unit contains an emulsion having primary sensitivity to light in the 500 to 600 nm range. A blue light sensitive layer unit comprises an emulsion having primary sensitivity to light in the 400 to 500 nm range. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure I*, cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure I*, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm, et al., U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure, I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be not more than 4.5 g/m$^2$ of silver, preferably less. Silver quantities of less than 4.0 g/m$^2$ are preferred, and silver quantities of less than 3.5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.0 g of coated silver per m$^2$ of support surface area in the element is necessary to realize an exposure latitude of at least 2.7 log E while maintaining an adequately low graininess position for pictures intended to be enlarged. Silver coverages in excess of 1.5 g/m$^2$ are preferred while silver coverages in excess of 2.5 g/m$^2$ are more preferred.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction-i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure I*, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure I*, Section VIII. Absorbing and scattering materials, B. Absorbing materials. In elements of the instant invention, magenta colored filter materials are absent from IL2 and RU.

The antihalation layer unit AHIU typically contains a processing solution removable or decolorizable light absorbing material, such as one or a combination of pigments and dyes. Suitable materials can-be selected from among those disclosed in *Research Disclosure I*, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure I*, Section IX. Coating physical property modifying addenda The SOC overlying the emulsion layers additionally preferably contains an ultraviolet absorber, such as illustrated by *Research Disclosure I*, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 pm mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density-i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing developing agents for producing yellow, magenta and cyan dyes, respectively, as is conventional practice in color negative elements used for printing. It is also possible, to replace one of the dyes by a infrared dye, as disclosed in commonly assigned co-pending U.S. Ser. No. 09/928834, hereby incorporated by reference. The invention can be suitably applied to conventional color negative construction as illustrated. Color reversal film construction would take a similar form, with the exception that colored masking couplers would be completely absent; in typical forms, development inhibitor releasing couplers would also be absent. In prefelTed embodiments, the color negative elements are intended exclusively for scanning to produce three separate electronic color records. It is desirable that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma's as low as 1.0 or even 0.6 are contemplated and exposure latitudes of up to about 5.0 log E or higher are feasible. Gammas above 0.25 are preferred and gammas above 0.30 are more preferred. Gammas of between about 0.4 and 0.5 are especially preferred.

In a preferred embodiment the dye image is formed by the use of an incorporated developing agent, in reactive association with each color layer. More preferably, the incorporated developing agent is a blocked developing agent.

Examples of blocking groups that can be used in photographic elements of the present invention include, but are not limited to, the blocking groups described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning, and in U.S. Pat. No. 5,019,492. Other examples of blocking groups that can be used in photographic elements of the present invention include, but are not limited to, the blocking groups described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492. Particularly useful are those blocking groups described in U.S. application Ser. No. 09/476,234, filed Dec. 30, 1999, IMAGING ELEMENT CONTAINING A BLOCKED PHOTOGRAPICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND; U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND; and U.S. application Ser. No. 09/476,233, filed Dec. 30, 1999, PHOTOGRAPHIC OR PHOTOTHERMOGRAPHIC ELEMENT CONTAINING A BLOCKED PHOTOGRAPHICALLY USEFUL COMPOUND. In one embodiment of the invention, the blocked developer is represented by the following Structure VIII:

$$\text{DEV—(LINK 1)}_{1}\text{—(TIME)}_{m}\text{—(LINK 2)}_{n}\text{—B} \qquad \text{VIII}$$

wherein,

DEV is a silver-halide color developing agent according to the present invention;

LINK 1 and LINK 2 are linking groups;

TIME is a timing group;

1 is 0 or 1;

m is 0, 1, or 2;

n is 0 or 1;

1+n is 1 or 2;

B is a blocking group or B is:

$$\text{—B'—LINK 2)}_{n}\text{—(TIME)}_{m}\text{—(LINK 1)}_{1}\text{—DEV}$$

wherein B' also blocks a second developing agent DEV.

In a preferred embodiment of the invention, LINK 1 or LINK 2 are of structure IX:

IX

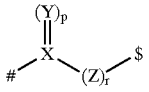

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

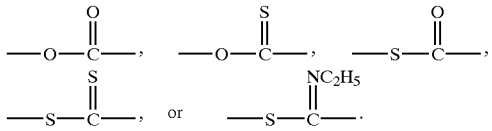

TIME is a timing group. Such groups are well-known in the art such as (1) groups utilizing an aromatic nucleophilic substitution reaction as disclosed in U.S. Pat. No. 5,262,291, (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. No. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Illustrative timing groups are illustrated by formulae T-1 through

T-1

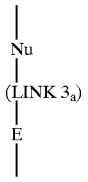

wherein:

Nu is a nucleophilic group;

E is an electrophilic group comprising one or more carbo- or hetero-aromatic rings, containing an electron deficient carbon atom;

LINK 3 is a linking group that provides 1 to 5 atoms in the direct path between the nucleopnilic site of Nu and the electron deficient carbon atom in E; and a is 0 or 1.

Such timing groups include, for example:

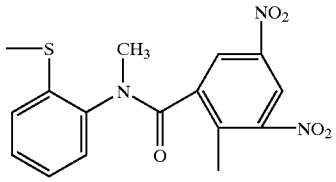

and

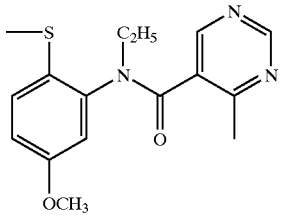

These timing groups are described more fully in U.S. Pat. No. 5,262,291, incorporated herein by reference.

T-2

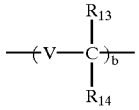

wherein

V represents an oxygen atom, a sulfur atom, or an

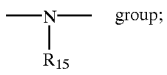

group;

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include

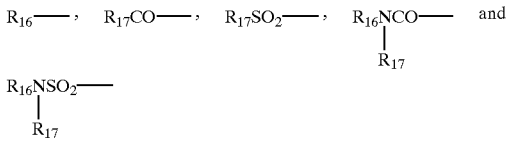

where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

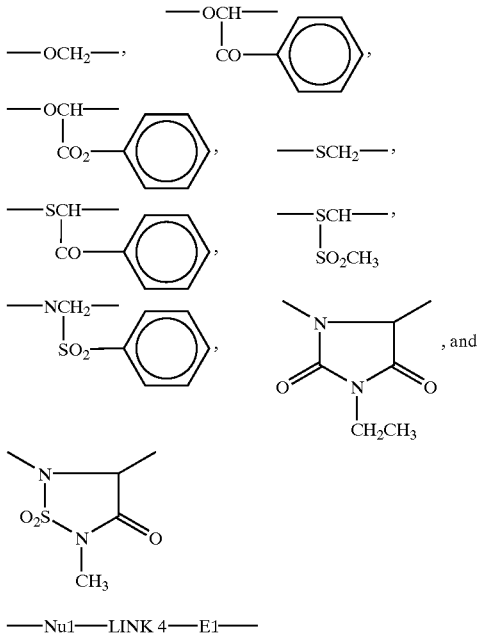

T-3 wherein Nu 1 represents a nucleophilic group, and an oxygen or sulfur atom can be given as an example of nucleophilic species, E1 represents an electrophilic group being a group which is subjected to nucleophilic attack by Nu 1; and LINK 4 represents a linking group which enables Nu 1 and E1 to have a steric arrangement such that an intramolecular nucleophilic substitution reaction can occur. Specific examples of the group represented by formula (T-3) are illustrated below.

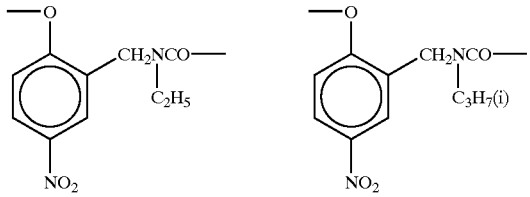

-continued

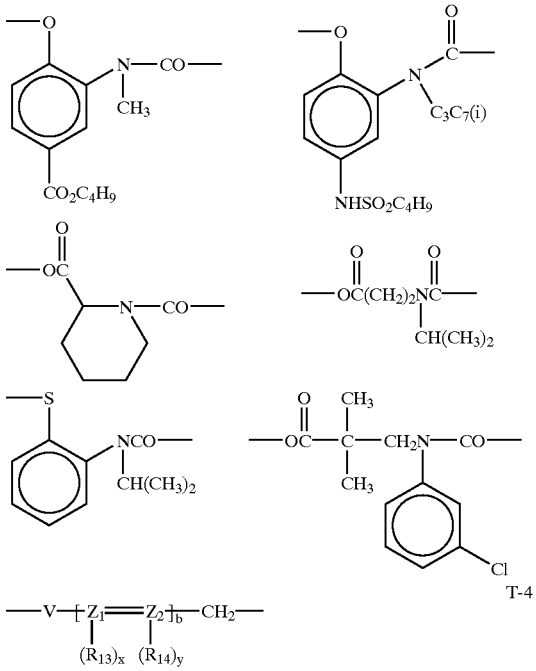

T-4 wherein V, $R_{13}$, $R_{14}$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ each independently represents a carbon atom or a nitrogen atom, and x and y each represents 0 or 1.

Specific examples of the timing group (T-4) are illustrated below.

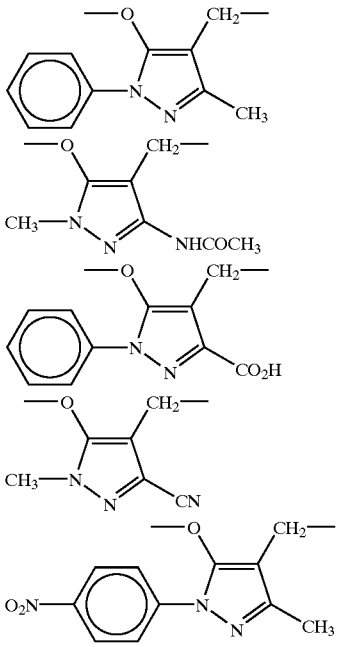

-continued
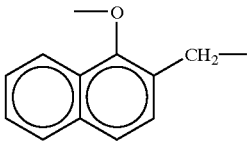
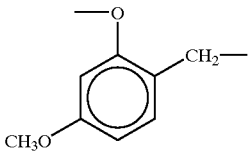
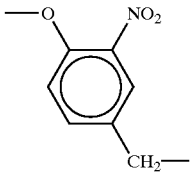
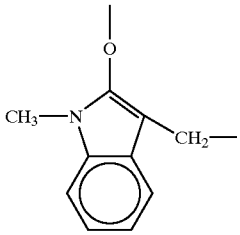
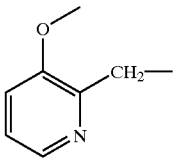
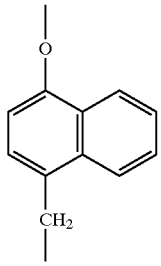
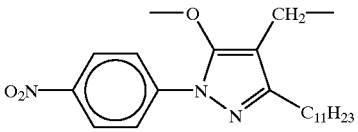
Although the present invention is not limited to any type of developing agent or blocked developing agent, the following are merely some examples of photographically useful blocked developers that may be used in the invention to produce developers of Structure II.
D-1
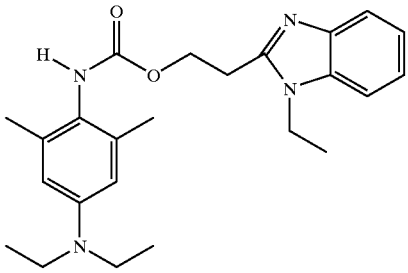
D-2
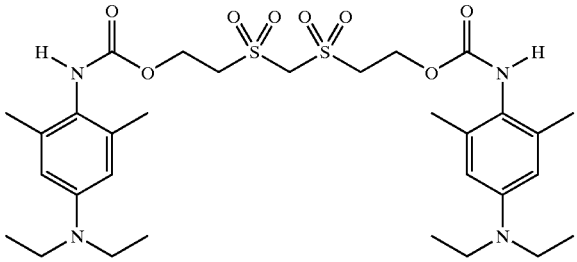
-continued
D-3
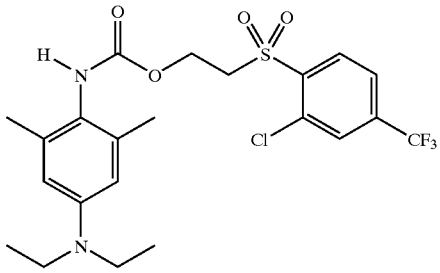
D-4
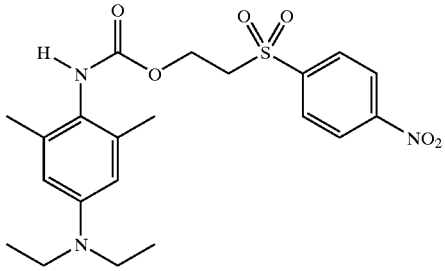
D-5
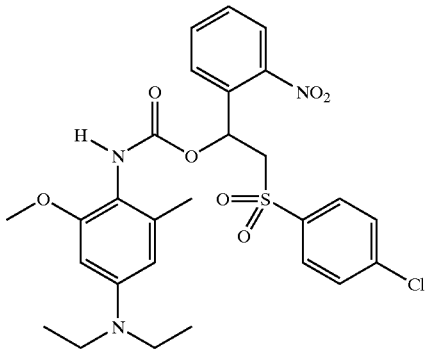
D-6
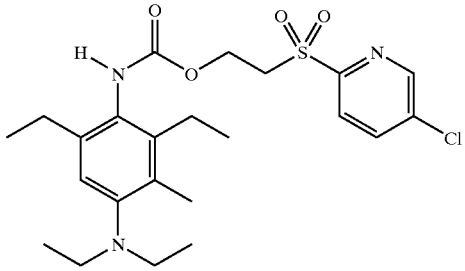
D-7
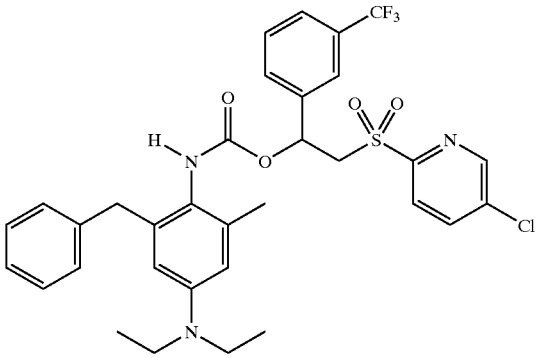

-continued

D-8

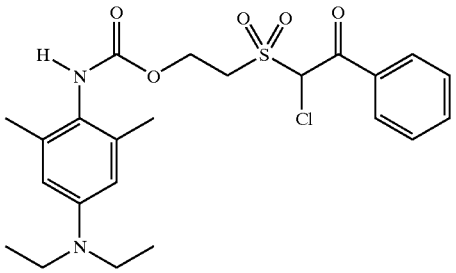

D-9

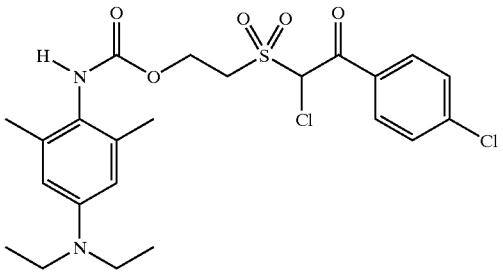

D-10

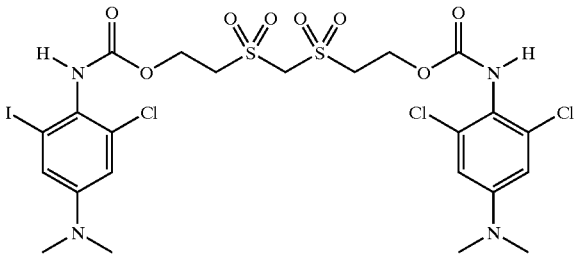

D-11

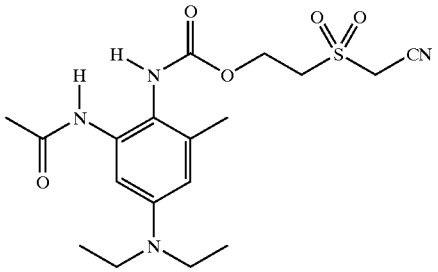

D-12

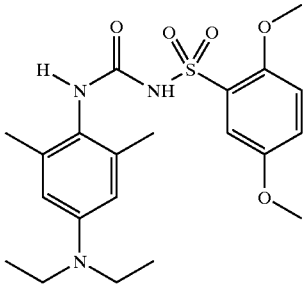

-continued

D-13

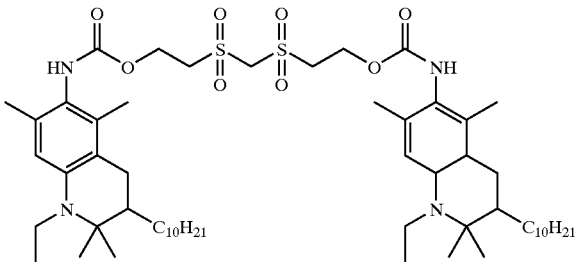

D-14

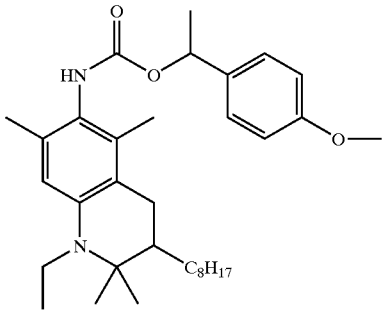

D-15

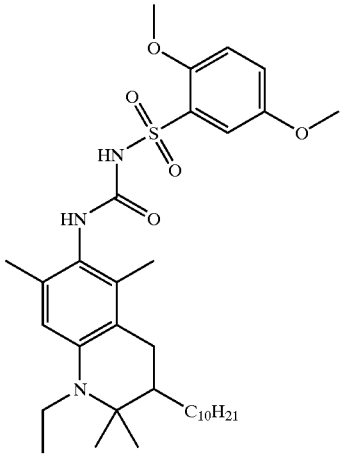

D-16

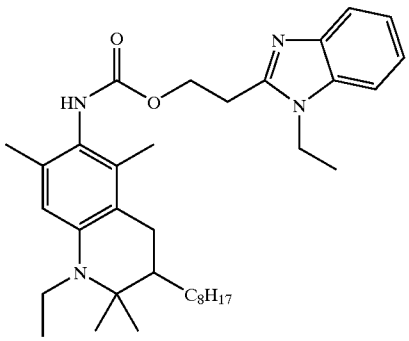

A number of modifications of color negative elements have been suggested for accommodating scanning, as illustrated by *Research Disclosure I*, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image that, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. In a like vein, it is preferred that the gamma ratios be greater than 0.8, more preferred that they be greater than 0.85 and most preferred that they be greater than 0.9. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photothermographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613, by Zander U.S. Pat. No. 5,200,777, by Dowling et at U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in Stoebe, et al., U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure I*, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The elements as discussed above may serve as origination material for some or all of the following processes: image scanning to produce an electronic rendition of the capture image, and subsequent digital processing of that rendition to manipulate, store, transmit, output, or display electronically that image.

The photothermographic elements according to the present invention can be of the type described in *Research Disclosure* 17029 are included by reference. The photothermographic elements may be of type A or type B as disclosed in *Research Disclosure I*. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992.

A photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-mhethylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

The photothermographic element can comprise a thermal solvent. Examples of useful thermal solvents. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure*, June 1978, Item No. 17029 and U.S. Pat. No. 4,123,282.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

After imagewise exposure of a photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed by Stoebe, et al., U.S. Pat No. 6,062,746 and Szajewski, et al., U.S. Pat No. 6,048,110, commonly assigned, which are incorporated herein by reference. The use of an apparatus whereby the processor can be used to write information onto the element, information which can be used to adjust processing, scanning, and image display is also envisaged. This system is disclosed in now allowed Stoebe, et al., U.S. patent applications Ser. Nos. 09/206,914 filed Dec. 7, 1998 and 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443.

After development and formation of an image from a PTG film, the retained silver halide and organic silver salt can remain in reactive association with the other film chemistry, making the film unsuitable as an archival media. Removal or stabilization of these silver sources are necessary to render the PTG film to an archival state. Furthermore, the silver coated in the PTG film (silver halide, silver donor, and metallic silver) is unnecessary to the dye image produced, and this silver is valuable and the desire is to recover it is high.

Thus, it may be desirable to remove, in subsequent processing steps, one or more of the silver containing components of the film: the silver halide, one or more silver donors, the silver-containing thermal fog inhibitor if present, and/or the silver metal. The three main sources are the developed metallic silver, the silver halide, and the silver donor. Alternately, it may be desirable to stabilize the silver halide in the photothermographic film. Silver can be wholly or partially stabilized/removed based on the total quantity of silver and/or the source of silver in the film.

The removal of the silver halide and silver donor can be accomplished with a common fixing chemical as known in the photographic arts. Specific examples of useful chemicals include: thioethers, thioureas, thiols, thiones, thionamides, amines, quaternary amine salts, ureas, thiosulfates, thiocyanates, bisulfites, amine oxides, iminodiethanol-sulfur dioxide addition complexes, amphoteric amines, bis-sulfonylmethanes, and the carbocyclic and heterocyclic derivatives of these compounds. These chemicals have the ability to form a soluble complex with silver ion and transport the silver out of the film into a receiving vehicle. The receiving vehicle can be another coated layer (laminate) or a conventional liquid processing bath.

The stabilization of the silver halide and silver donor can also be accomplished with a common stabilization chemical. The previously mentioned silver salt removal compounds can be employed in this regard. With stabilization, the silver is not necessarily removed from the film, although the fixing agent and stabilization agents could very well be a single chemical. The physical state of the stabilized silver is no longer in large (>50 nm) particles as it was for the silver halide and silver donor, so the stabilized state is also advantaged in that light scatter and overall density is lower, rendering the image more suitable for scanning.

The removal of the metallic silver is more difficult than removal of the silver halide and silver donor. In general, two reaction steps are involved. The first step is to bleach the metallic silver to silver ion. The second step may be identical to the removal/stabilization step(s) described for silver halide and silver donor above. Metallic silver is a stable state that does not compromise the archival stability of the PTG film. Therefore, if stabilization of the PTG film is favored over removal of silver, the bleach step can be skipped and the metallic silver left in the film. In cases where the metallic silver is removed, the bleach and fix steps can be done together (called a blix) or sequentially (bleach+fix).

The process could involve one or more of the scenarios or permutations of steps. The steps can be done one right after another or can be delayed with respect to time and location. For instance, heat development and scanning can be done in a remote kiosk, then bleaching and fixing accomplished several days later at a retail photofinishing lab. In one embodiment, multiple scanning of images is accomplished. For example, an initial scan may be done for soft display or a lower cost hard display of the image after heat processing, then a higher quality or a higher cost secondary scan after stabilization is accomplished for archiving and printing, optionally based on a selection from the initial display.

For illustrative purposes, a non-exhaustive list of photothermographic film processes involving a common dry heat development step are as follows:

1. heat development→scan→stabilize (for example, with a laminate)→scan→obtain returnable archival film.
2. heat development→fix bath→water wash→dry→scan→obtain returnable archival film
3. heat development→scan→blix bath→dry→scan→recycle all or part of the silver in film
4. heat development→bleach laminate→fix laminate→scan→(recycle all or part of the silver in film)
5. heat development→scan→blix bath→wash→fix bath→wash→dry→obtain returnable archival film
6. heat development→relatively rapid, low quality scan
7. heat development→bleach→wash→fix→wash→dry→relatively slow, high quality scan Photothermographic or photographic elements of the present invention can also be subjected to low volume processing ("substantially dry" or "apparently dry") which is defined as photographic processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume processing system may contain any of the elements described above for Type I: Photothermographic systems. In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below.

The Type II photothermographic element may receive some or all of the following three treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element.

The transferred image may result from a dye, dye precursor, or silver containing compound being transferred in a image-wise manner to the auxiliary processing element.

Heating of the element during processing may be effected by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Once yellow, magenta, and cyan dye image records (or the like) have been formed in the processed photographic elements of the invention, conventional techniques can be employed for retrieving the image information for each color record and manipulating the record for subsequent creation of a color balanced viewable image. For example, it is possible to scan the photothermographic element successively within the blue, green, and red regions of the spectrum or to incorporate blue, green, and red light within a single scanning beam that is divided and passed through blue, green, and red filters to form separate scanning beams for each color record. A simple technique is to scan the photothermnographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370, Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569, Sullivan et al U.S. Pat. Nos. 4,920,501 and 5,070,413; Kimoto et al U.S. Pat. No. 4,929,979, Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

In the preferred embodiment of a photothermographic film according to the present invention, the processing time to first image (either hard or soft display for customer/consumer viewing), including (i) thermal development of a film, (ii) scanning, and (iii) the formation of the positive image from the developed film, is suitably less than 5 minutes, preferably less than 3.5 minutes, more preferably less than 2 minutes, most preferably less than about 1 minute. In one embodiment, such film might be amenable to development at kiosks, with the use of simple dry or apparently dry equipment. Thus, it is envisioned that a consumer could bring an imagewise exposed photographic film, for development and printing, to a kiosk located at any one of a number of diverse locations, optionally independent from a wet-development lab, where the film could be developed and printed without any manipulation by third-party technicians. A photothermographic color film, in which a silver-halide-containing color photographic element after imagewise exposure can be developed merely by the external application of heat and/or relatively small amounts of alkaline or acidic water, but which same film is also amenable to development in an automated kiosk, preferably not requiring third-party manipulation, would have significant advantages. Assuming the availability and accessibility of such kiosks, such photothermographic films could potentially be developed at any time of day, "on demand," in a matter minutes, without requiring the participation of third-party processors, multiple-tank equipment and the like. Optionally, such photographic processing could potentially be done on an "as needed" basis, even one roll at a time, without necessitating the high-volume processing that would justify, in a commercial setting, equipment capable of high-throughput. Color development and subsequent scanning of such a film could readily occur on an individual consumer basis, with the option of generating a display element corresponding to the developed color image. By kiosk is meant an automated free-standing machine, self-contained and (in exchange for certain payments) capable of developing a roll of imagewise exposed film on a roll-by-roll basis, without the intervention of technicians or other third-party persons such as necessary in wet-chemical laboratories. Typically, the customer will initiate and control the carrying out of film processing and optional printing by means of a computer interface. Such kiosks typically will be less than 6 cubic meters in dimension, preferably 3 cubic meters or less in dimension, and hence commercially transportable to diverse locations. Such kiosks may optionally comprise a heater for color development, a scanner for digitally recording the color image, and a device for transferring the color image to a display element.

PREPARATIVE EXAMPLES

The following examples illustrate the synthesis of representative blocked compounds useful in the invention.

Preparation of D-2:

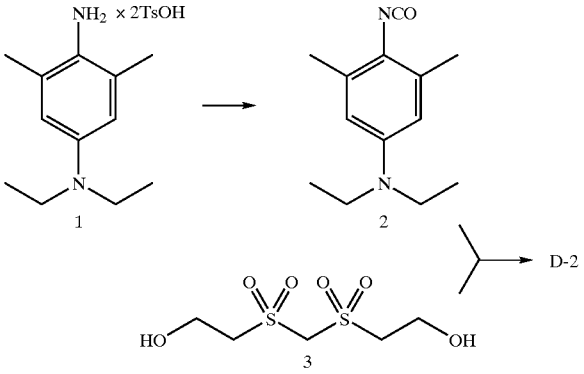

Preparation of 2:

Water (450 mL) was slowly added at 0° C. to a mixture of 2,6-dimethyl-4-(N,N-diethyl)aniline ditosylate (1) (268.4 g, 0.50 mol), potassium bicarbonate (500.6 g, 5.00 mol) and dichloromethane (900 mL), followed by a 1.9M toluene solution of phosgene (550 mL, 1.00 mol) at 4–7° C. over a period of 30 min. Following the addition, the mixture was stirred cold for 30 min and diluted with dichloromethane (750 mL) and water (1000 mL). The layers were separated and the aqueous one extracted with dichloromethane (350 mL). Combined organic solutions were dried over sodium sulfate and the solvents were distilled off in vacuo at 45° C. The crude product was dissolved in ligroin (700 mL), the solution treated with charcoal, filtered through SuperCel and concentrated in vacuo at 50° C., giving 111.0 g (0.50 mol, 100%) of isocyanate 2 as a yellow oil. $^1$H NMR ($CDCl_3$): δ 6.35 (s, 2H), 3.30 (q, 4H), 2.25 (s, 6H), 1.15 (t, 6H).

Preparation of D-2.

A solution of isocyanate 2 (177.6 g, 0.81 mol), diol 3 (87.1 g, 0.375 mol) and dibutyltin diacetate (1 mL) in 900 mL of acetonitrile was stirred at 50° C. under nitrogen for 3 days. The mixture was cooled to room temperature, filtered and the filtrate taken to dryness. The crystalline residue was stirred with isopropyl ether (500 mL), the product collected by filtration, washed with isopropyl ether (2×250 mL) and then ethanol (2×250 mL). Yield 220.9 g (0.33 mol, 88%), m.p. 173–175° C.

Preparation of D-3, D-4 and D-9:

Blocked developers D-3, D-4 and D-9 were prepared as described above for D-2 from isocyanate 2 and appropriate alcohols in the presence of catalytic amounts of dibutyltin diacetate. The yields and melting points are listed below in Table 1 below.

TABLE 1

| Developer | Yield (%) | m.p. (° C.) |
|---|---|---|
| D-3 | | 161–163 |
| D-4 | 84 | 91–93 |
| D-9 | 79 | 110–114 |

PHOTOGRAPHIC EXAMPLES

Photothermographic coating examples were prepared using the following components:

Developers D-1, D-2, or D3:

Developers were incorporated into the photographic coatings as ball-milled dispersions. The dispersions were prepared by ball-milling the compounds with zirconia beads in water. TRITON X-200 was added to the dispersions as a surfactant. Typically, the developers were incorporated into the slurry at 10% (w/w), and the TRITON X-200 was added at a level of 10% by weight of the developer.

D-17

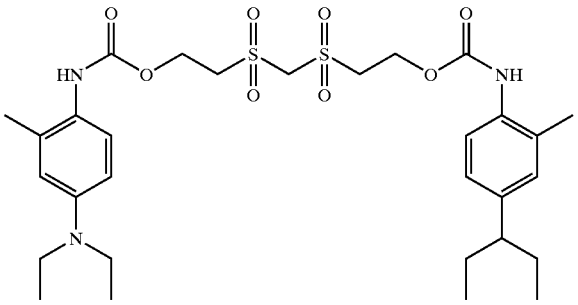

D-2

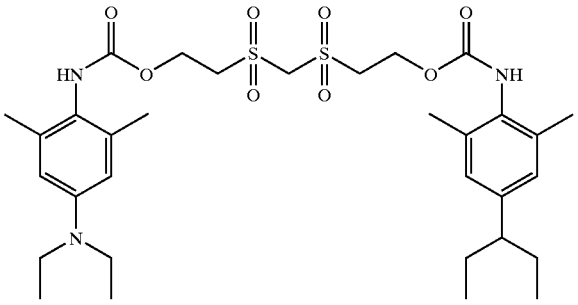

D-12

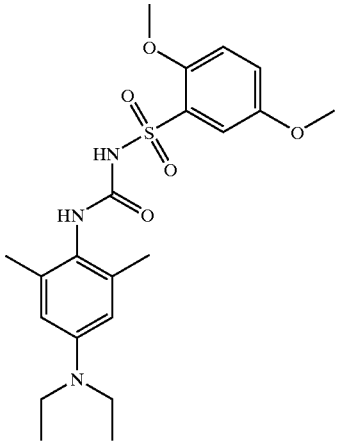

Couplers were incorporated into photographic coatings as conventional dispersions using a high-boiling organic liquid as solvent. Coupler C-1 was dispersed with 40% (w/w) of mixed tricresyl phosphates and 10% (w/w) of compound A-1 in aqueous gelatin. The final weight percent of the coupler in the dispersion was 5.5%. The gelatin content of the dispersion was 8.8%. Coupler C-18 was dispersed with an equal weight of dibutyl sebacate. The final weight percent of coupler C-18 in its dispersion was 7.7%, and the gel percent was 8.8%. All other couplers were dispersed with an equal weight of tricresyl phosphate, at a concentration of 5% coupler, 6% gel.

C-1

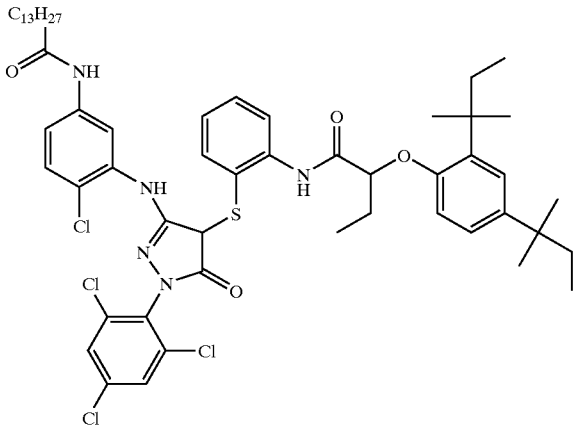

Compound A-1

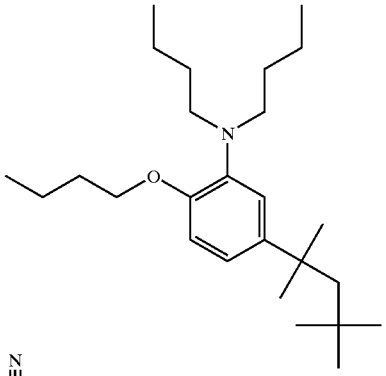

C-18

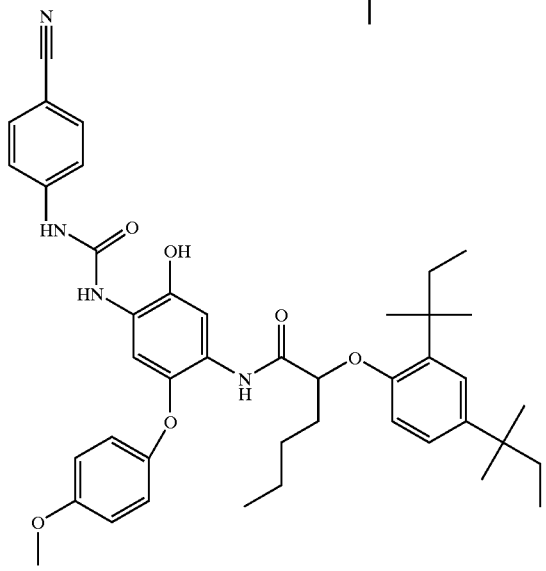

Prior-art coupler C-18 is a commonly used 2-p-cyanophenylureido substituted coupler described in commonly owned U.S. Pat. No. 4,333,999 and EP 028,099 to Lau, which patents are hereby incorporated by reference.

Melt Former MF-1:

A dispersion of salicylanilide (MF-1) was media-milled to give a dispersion containing 30% salicylanilide, with 4% TRITON X-200 surfactant and 4% polyvinyl pyrrolidone added relative to the weight of salicylanilide. The dispersion was then diluted with water to provide a final salicylanilide concentration of 25%.

MF-1

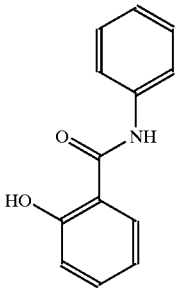

Silver Salt Dispersion SS-1:

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 41 solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

Silver Salt Dispersion SS-2:

A stirred reaction vessel was charged with 431 g of lime processed gelatin and 6569 g of distilled water. A solution containing 320 g of 1-phenyl-5-mercaptotetrazole , 2044 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 41 solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Emulsion E-1:

A silver halide tabular emulsion with a composition of 96% silver bromide and 4% silver iodide was prepared by conventional means. The resulting emulsion had an equivalent circular diameter of 1.2 microns and a thickness of 0.11 microns. This emulsion was spectrally sensitized to green light by addition of a combination of dyes SM-1 and SM-2 at a ratio of 4.5:1 and then chemically sensitized for optimum performance.

SM-1

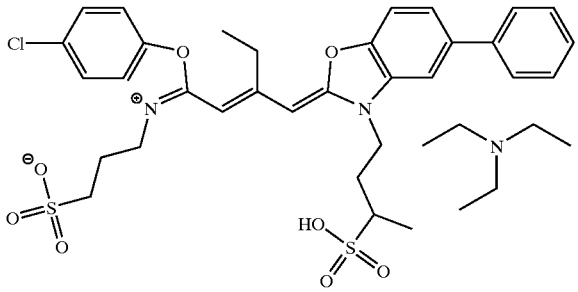

-continued

SM-2

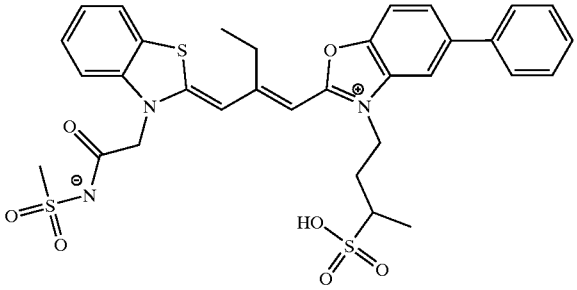

Emulsion E-2:

A silver halide tabular emulsion with a composition of 97% silver bromide and 3% silver iodide was prepared by conventional means. The resulting emulsion had an equivalent circular diameter of 0.41 microns and a thickness of 0.06 microns. This emulsion was spectrally sensitized to blue light by addition of dye SY-1 dye and then chemically sensitized for optimum performance.

SY-1

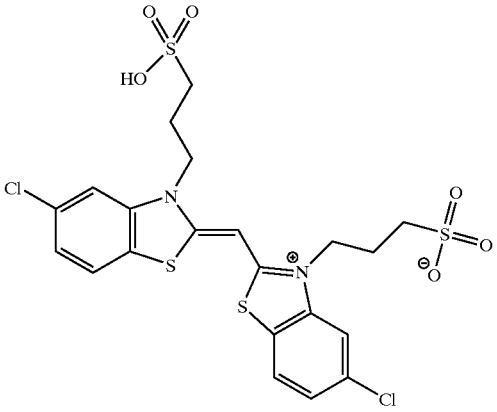

Example 1

To demonstrate that pyrazolone couplers form cyan dyes when used in combination with a hue-shifting developer, photothermographic coatings were prepared on 4 mil polyethyleneterephthalate (PET) support using components at the levels given in Table 1.

TABLE 1

| | |
|---|---|
| Developer D-17, D-2, or D-12 | 1.34 mmol/sq m for D-17 and D-2<br>2.68 mmol/sq m for D-12 |
| Silver Salt SS-1 | 0.32 g Ag/sq m |
| Silver Salt SS-2 | 0.32 g Ag/sq m |
| Meltformer MF-1 | 0.86 g/sq m |
| Coupler C-1 | 0.45 g/sq m |
| Emulsion E-2 | 0.86 g Ag/sq m |
| Gelatin Binder | 4.30 g/sq m |

The coatings were exposed through a stepped exposure and 10 subsequently processed by heating for 18 seconds at 161° C. Following processing, the light-sensitive silver halide was removed from the coatings by fixing in a sodium thiosulfate bath. The spectrum of the coatings at Dmax was measured using a Perkin-Elmer LAMBDA 20 UV/visible spectrophotometer. The coatings were scanned from 750 to 400 nm, and the results are given in Table 2.

TABLE 2

| Sample | Developer | Wavelength of maximum absorption (lambda max) |
|---|---|---|
| 1-1 (Comparison) | D-17 | 546 nm |
| 1-2 (Invention) | D-2 | 632 nm |
| 1-3 (Invention) | D-12 | 635 nm |

As seen in this example, the use of a pyrazolone coupler with a hue-shifting developer in a photothermographic coating leads to an excellent cyan dye.

Example 2

To demonstrate that the invention is superior to conventional cyan couplers known to the art, photothermographic coatings were prepared using the components in Table 3. The coatings were prepared on 4 mil polyethyleneterephthalate support.

TABLE 3

| | |
|---|---|
| Developer D-17 or D-2 | 1.34 mmol/$m^2$ |
| Silver Salt SS-1 | 0.32 g Ag/$m^2$ |
| Silver Salt SS-2 | 0.32 g Ag/$m^2$ |
| Melt Former MF-1 | 0.86 g/$m^2$ |
| Coupler C-1 or C-18 | 0.51 mmol/$m^2$ for C-1<br>0.89 mmol/$m^2$ for C-18 |
| Emulsion E-2 | 0.86 g Ag/$m^2$ |
| Gelatin Binder | 4.30 g/$m^2$ |

The coatings of Example 2 were exposed through a stepped exposure wedge and subsequently processed by heating for 20 seconds at 150° C. Following processing, the light-sensitive silver halide was removed from the coatings by fixing in a thiosulfate bath. The spectrum of the coatings at Dmax was measured as before, and the results are presented in Table 4. In addition to the absorption maxima, the status M red density of each coating was determined using an X-Rite densitometer. The red Dmax data are listed in the last column of Table 4.

TABLE 4

| Sample | Coupler | Developer | Wavelength of Maximum Absorption (lambda max) | Status M Red Dmax |
|---|---|---|---|---|
| 2-1 (Comp.) | C-1 | D-17 | 546 nm | 0.54 |
| 2-2 (Comp) | C-18 | D-17 | 676 nm | 1.10 |
| 3-2 (Invention) | C-1 | D-2 | 632 nm | 1.98 |

These data show that in addition to forming cyan dye in a photothermographic coating, the use of pyrazolone couplers and hue-shifting developers leads to more cyan dye density than the combination of phenol couplers with conventional developers.

Example 3

C-3 to C- Additional examples of the invention using different pyrazolone couplers 8 below were prepared in a manner similar to Examples 1 and 2 above.

C-2
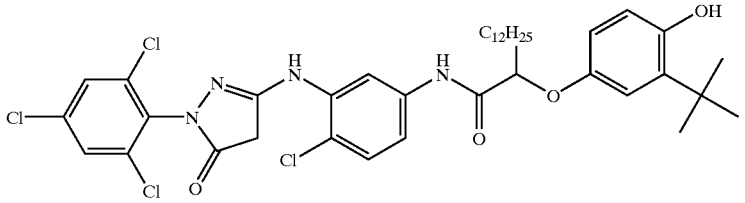
C-3
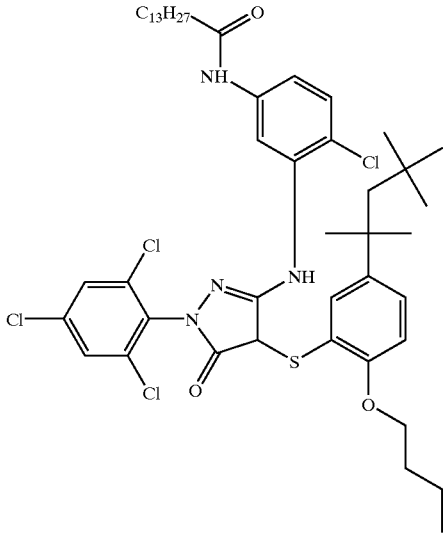
C-4
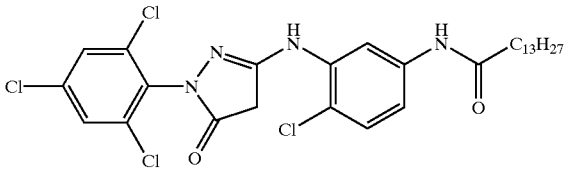
C-5
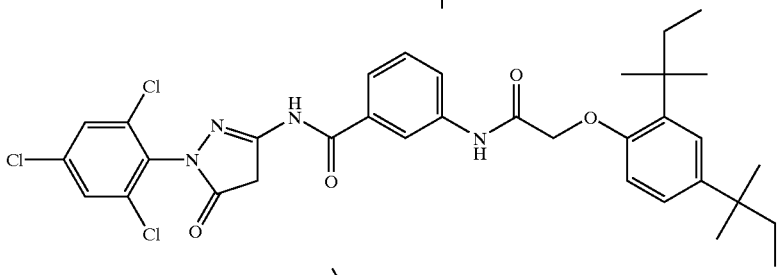
C-6
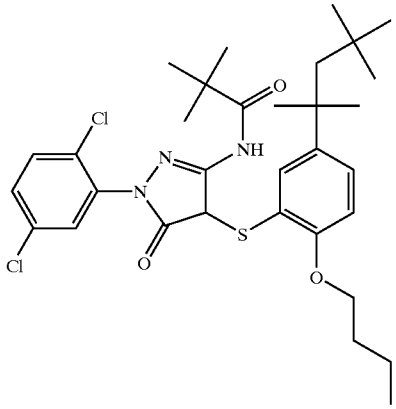
C-7
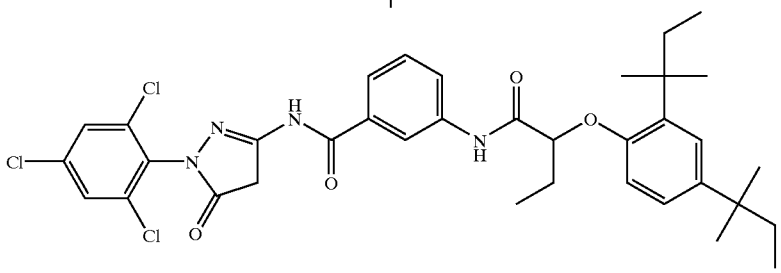

The apparent hue and wavelength absorption maxima data for the dyes formed upon thermally processing these coatings are listed in Table 5.

TABLE 5

| Sample | Coupler | Hue of Coating with Developer D-1 (Comparison) | Hue of Coating with Developer D-2 (Invention) | Lambda max of dye with Developer D-2 |
|---|---|---|---|---|
| 3-1 | C-2 | Magenta | Cyan | 634 nm |
| 3-2 | C-3 | Magenta | Cyan | 630 nm |
| 3-3 | C-4 | Magenta | Cyan | 636 nm |
| 3-4 | C-5 | Magenta | Cyan | 650 nm |
| 3-5 | C-6 | Magenta | Cyan | 638 nm |
| 3-6 | C-7 | Magenta | Cyan | 652 nm |

Example 4

Additional photothermographic coatings were prepared with couplers C-8 to C-17 below, in a manner similar to Example 1, using D-2 as the incorporated developing agent. Upon thermal processing, all coatings generated a cyan hue

C-8

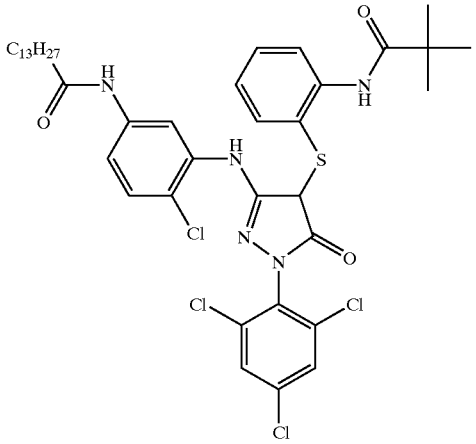

C-9

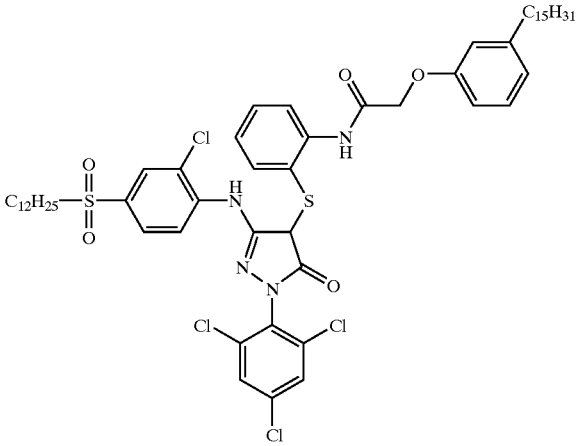

-continued

C-10

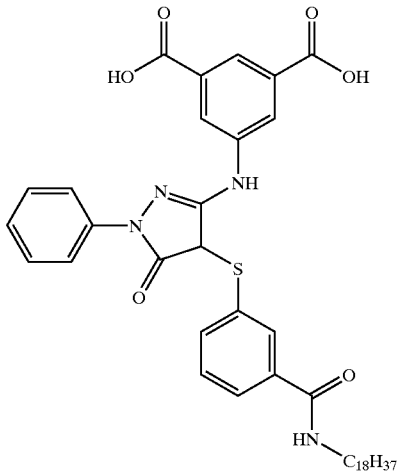

C-11

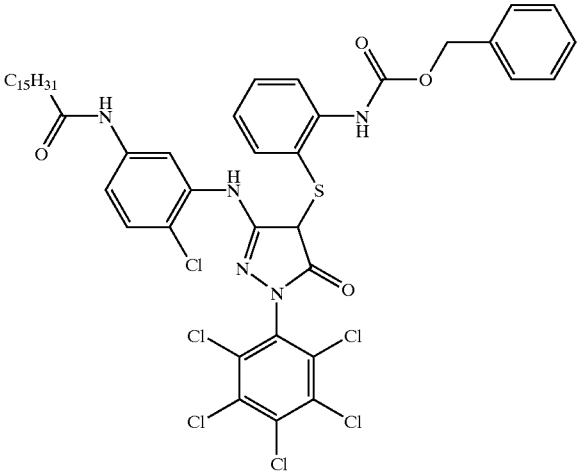

C-12

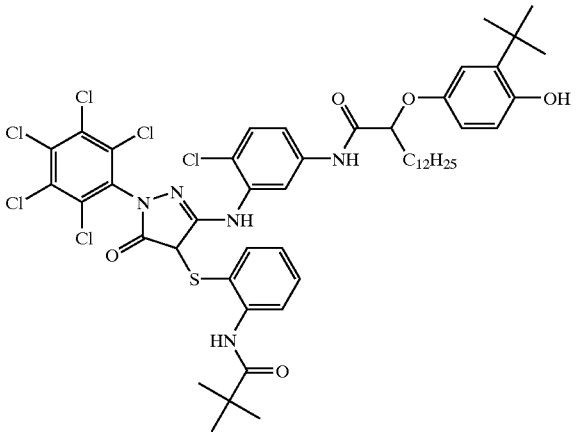

-continued

C-13

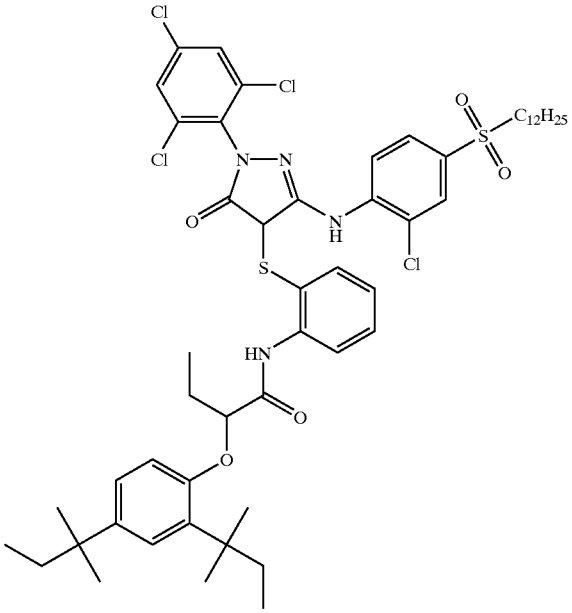

C-14

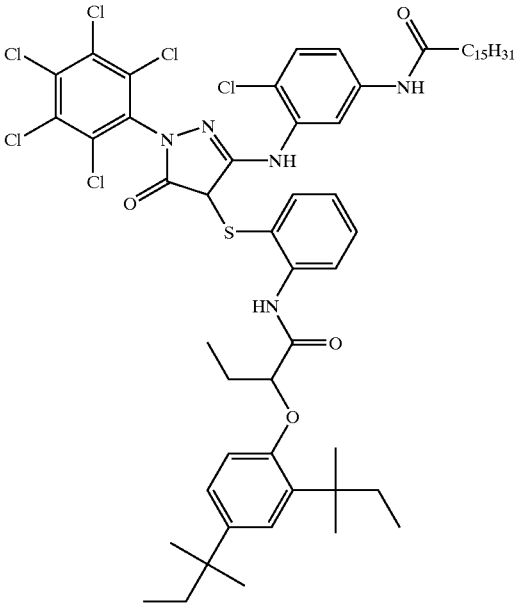

C-15

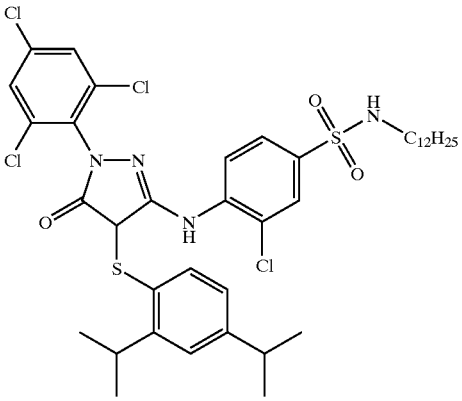

-continued

C-16

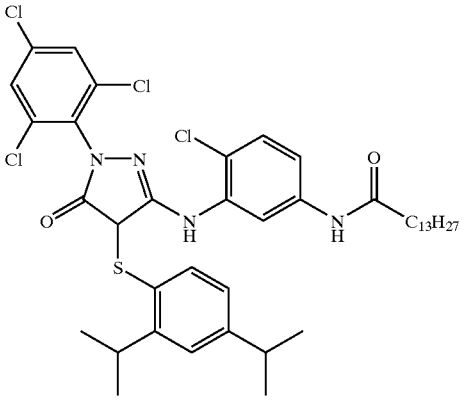

C-17

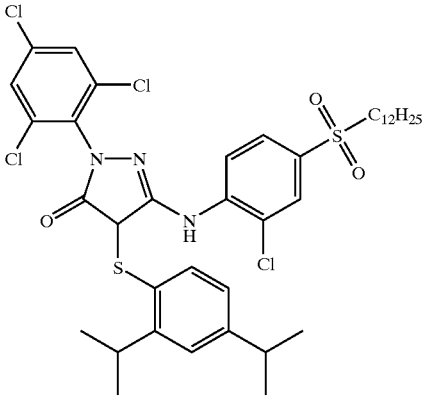

The invention has been described in detail with particular reference to certain preferred embodiments thereof, but it will be understood that variations and modifications can be effected within the spirit and scope of the invention.

What is claimed is:

1. A color photothermographic imaging element comprising a pyrazolone coupler in reactive association with a developer precursor that liberates a developing agent, the oxidized form of which forms a cyan colored dye with the pyrazolone coupler in at least one imaging layer of the imaging element, wherein the coupler is selected such that it would have been capable of forming a magenta dye with an oxidized form of the conventional developer 4-(N-ethyl-N-2-hydroxyethyl)-2-methylphenylenediamine.

2. The color photothermographic imaging element of claim 1, wherein the developer precursor liberates a developer that is a phenylenediamine compound having 2,6 ortho substitution, and wherein the pyrazolone coupler has the following structure:

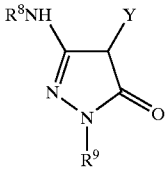

wherein $R^8$ is an alkyl group, an aryl group, an acyl group or a carbamoyl group, $R^9$ is a phenyl group or a phenyl group having at least one halogen atom, or at least one alkyl, cyano, alkoxyl, alkoxycarbonyl or acylamino group as a substituent group, wherein $R^8$ and $R^9$ may have substituent groups, each of which is an organic substituent group linked through a carbon atom, a oxygen atom, a nitrogen atom or a sulfur atom, or a halogen atom, and Y is a hydrogen atom or a group which is removable by the coupling reaction with the oxidant of the developing agent.

3. The color photothermographic imaging element of claim 1, wherein the developer precursor liberates a developer represented by the following structure:

I

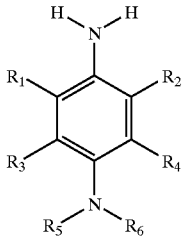

wherein $R^1$, R2, $R^3$, $R^4$, $R^5$ and $R^6$ which can be the same or different are individually H, alkyl, substituted alkyl, alkenyl, substituted alkenyl, aryl, substituted aryl, halogen, cyano, hydroxy, alkoxy, substituted alkoxy, aryloxy, substituted aryloxy, amino, substituted amino, alkylcarbonamido, substituted alkylcarbonamido, arylcarbonamido, substituted arylcarbonamido, alkylsulfonamido, arylsulfonamido, substituted alkylsulfonamido, substituted arylsulfonamido, or sulfamyl or wherein at least two of $R^1$, $R^2$, $R^3$, $R^4$, $R^5$ and $R^6$ together may further form a substituted or unsubstituted carbocyclic or heterocyclic ring structure; except that neither $R^{1\ nor\ R2}$ can be H; and wherein the coupler has the following structure:

(V)

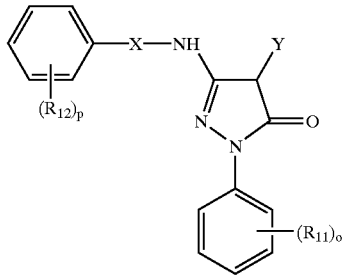

wherein $R_{11}$ is a substituent from the group comprising halogen, CN, alkylsulphonyl, arylsulphonyl, sulphamoyl, sulphamido, carbamoyl, carbonamido, alkoxy, acyloxyl, aryloxy, alkoxycarbonyl, ureido, nitro, alkyl and trifluoromethyl; $R_{12}$ is a substituent such as $R_{11}$ or aryl, alkylsulphoxyl, arylsulphoxyl, acyl, imido, carbamato, heteroacylyl, alkylthio, carboxyl or hydroxyl; Y is an elimination or coupling-off group; and X is a direct bond or CO; and o and p is 0 or a number from 1 to 5, wherein, should o and/or p be greater than 1, the substituents $R_{11}$ or $R_{12}$ may be identical or different.

4. The color photothermographic imaging element of claim 3, wherein the developer precursor liberates a developer represented by the following structure:

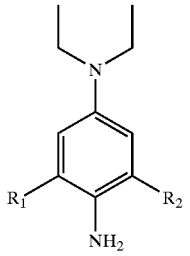

wherein $R^1$ and $R^2$ are as described above.

5. The color photothermographic imaging element of claim 1, wherein the element comprises a red-light-sensitive-layer unit, a green-light-sensitive layer unit and a blue-light-sensitive layer unit, wherein at least one layer unit has in reactive association the pyrazalone coupler and the developer precursor of claim 1.

6. The color photothennographic imaging element of claim 3 wherein the coupler has the following structure:

(VI)

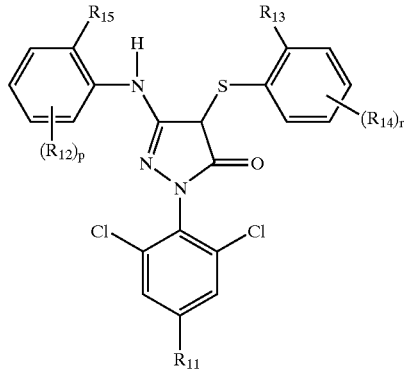

wherein $R_{11}$ and $R_{12}$ is defined above; $R_{13}$ is substituted or unsubstituted acylamino or sulphonylamino; $R_{14}$ is hydrogen or a substituted or unsubstituted organic residue, $R_{15}$ is chlorine or C1–C4 alkoxy, and r and p mutually independently is 0, 1 or 2.

7. The color photothermographic imaging element of claim 6 wherein the coupler has the following structure:

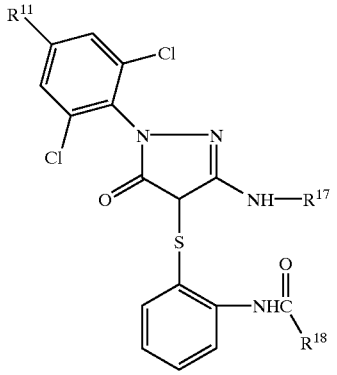

wherein $R^{11}$ is as defined above, $R^{17}$ is a chloro and alkanamido substituted phenyl, and $R^{18}$ is a substituted or unsubstituted phenoxy alkyl.

8. The color photothermographic imaging element of claim 1, wherein the element comprises a red-light sensitive layer unit, a green-light sensitive layer unit and a blue-light sensitive layer unit and wherein all three layer units have in reactive association an independently selected dye forming coupler and an independently selected blocked developer, wherein the dye coupler is different in each layer unit and the developing agent is different in at least two layer units.

9. The color photothermographic imaging element of claim 1 wherein the element comprises a red-light sensitive layer unit, a green-light sensitive layer unit and a blue-light sensitive layer unit and wherein all three layer units have in reactive association an independently selected dye forming coupler and an independently selected blocked developer, wherein the dye-forming couplers are the same in two of the layer units and wherein the blocked developer is different in said two layer units.

10. The color photothermographic imaging element of claim 1, wherein the element is capable of essentially dry development.

11. The element of claim 1, wherein said blocked developer and coupler is in reactive association within a red-light sensitive color layer unit.

12. The element of claim 1, wherein once imagewise exposed, the element is capable of being developed by heat treatment above 100° C.

13. The element of claim 1, wherein once imagewise exposed, the element is capable of being developed by treatment with base either by contacting the element to a pH controlling solution or by contacting the element to a pH controlling laminate.

14. The element of claim 1, wherein the color photographic element has a red-light sensitive silver halide layer unit and a first blocked coupling developer, a green-light sensitive silver halide layer unit and a second blocked coupling developer and a blue-light sensitive silver halide layer unit having a third blocked coupling developer.

15. A method of processing an imagewise exposed photothermographic element comprising thermally developing the imagewise exposed element to form an image and then scanning the element to form a first electronic image representation of the developed image in the element, wherein at least one image recording layer in the element comprises a cyan dye that is the reaction product of a pyrazolone coupler and a phenylene diamine developer or phenylene diamine developer precursor that liberates a developing agent, wherein said coupler is selected such that it would have been capable of forming a magenta dye with an oxidized form of the conventional developer 4-(N-ethyl-N-2-hydroxyethyl)-2-methylphenyenlnediamine.

16. The method according to claim 15 further comprising digitizing the first electronic image representation formed from the imagewise exposed, developed, and scanned photographic element to form a digital image.

17. The method according to claim 16 comprising the step of modifying the first electronic image representation formed from the imagewise exposed, developed, and scanned photographic element to form a second electronic image representation.

18. The method according to claim 17 comprising storing, transmitting, printing, or displaying an electronic image representation of an image derived from the imagewise exposed, developed, and scanned photographic element.

19. The method according to claim 18, wherein said electronic image representation is a digital image.

20. The method according to claim 18, wherein printing the image is accomplished by a printing technology selected from the group consisting of electrophotography, inkjet; thermal dye sublimation; and CRT or LED printing to sensitized photographic paper.

21. The method according to claim 15 wherein the photothermographic element contains an imaging layer comprising a blocked developer, a light-sensitive silver halide emulsion, an image dye-forming coupler and a non-light sensitive silver salt oxidizing agent.

22. The method according to claim 15 wherein the developing is accomplished in a dry state without the application of aqueous solutions.

23. The method according to claim 15 wherein the total amount of color masking coupler, the total amount of permanent Dmin adjusting dyes, and the permanent antihalation density, in blue, green and red density, is controlled so that the overall Dmin of the film minimizes the overall scanning noise during scanning.

24. A method according to claim 15 wherein said scanning occurs after partial de-silvering of said element.

* * * * *